US010150298B2

(12) United States Patent
Arakane

(10) Patent No.: US 10,150,298 B2
(45) Date of Patent: Dec. 11, 2018

(54) INK-JET PRINTER

(71) Applicant: BROTHER KOGYO KABUSHIKI KAISHA, Nagoya-shi, Aichi-ken (JP)

(72) Inventor: Satoru Arakane, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/655,631

(22) Filed: Jul. 20, 2017

(65) Prior Publication Data

US 2018/0029369 A1 Feb. 1, 2018

(30) Foreign Application Priority Data

Jul. 29, 2016 (JP) ..... 2016-149566

(51) Int. Cl.
*B41J 2/165* (2006.01)
*B41J 2/145* (2006.01)

(52) U.S. Cl.
CPC ..... *B41J 2/16517* (2013.01); *B41J 2/145* (2013.01); *B41J 2/16505* (2013.01); *B41J 2/16526* (2013.01); *B41J 2002/16573* (2013.01)

(58) Field of Classification Search
CPC ..... B41J 2/16526; B41J 2002/16529
See application file for complete search history.

(56) References Cited

U.S. PATENT DOCUMENTS

2002/0126308 A1* 9/2002 Uetsuki ..... B41J 2/16517 358/1.14
2004/0184081 A1 9/2004 Yamamoto
2006/0187257 A1* 8/2006 Ito ..... B41J 2/16526 347/35
2015/0029249 A1* 1/2015 Seino ..... B41J 29/393 347/9
2015/0085013 A1* 3/2015 Ito ..... B41J 2/16505 347/29

FOREIGN PATENT DOCUMENTS

JP 04062065 A * 2/1992
JP 2000-141822 A 5/2000
JP 2000-163225 A 6/2000
JP 2015-205519 A 11/2015

* cited by examiner

*Primary Examiner* — Shelby Fidler
(74) *Attorney, Agent, or Firm* — Merchant & Gould P.C.

(57) ABSTRACT

There is provided an ink-jet printer including: a conveyer, a recording head, an ink receiver, a communicating interface and a controller. Under a condition that the controller receives a preceding command, the controller is configured to execute a first flushing processing; and under a condition that an elapsed time, elapsed after completion of the first flushing processing and until receipt of a recording command is not less than a threshold time in a case that the controller receives the recording command, the controller is configured to execute a second flushing processing and a recording processing, whereas under a condition that the elapsed time is less than the threshold time, the controller is configured to execute the recording processing without executing the second flushing processing.

11 Claims, 10 Drawing Sheets

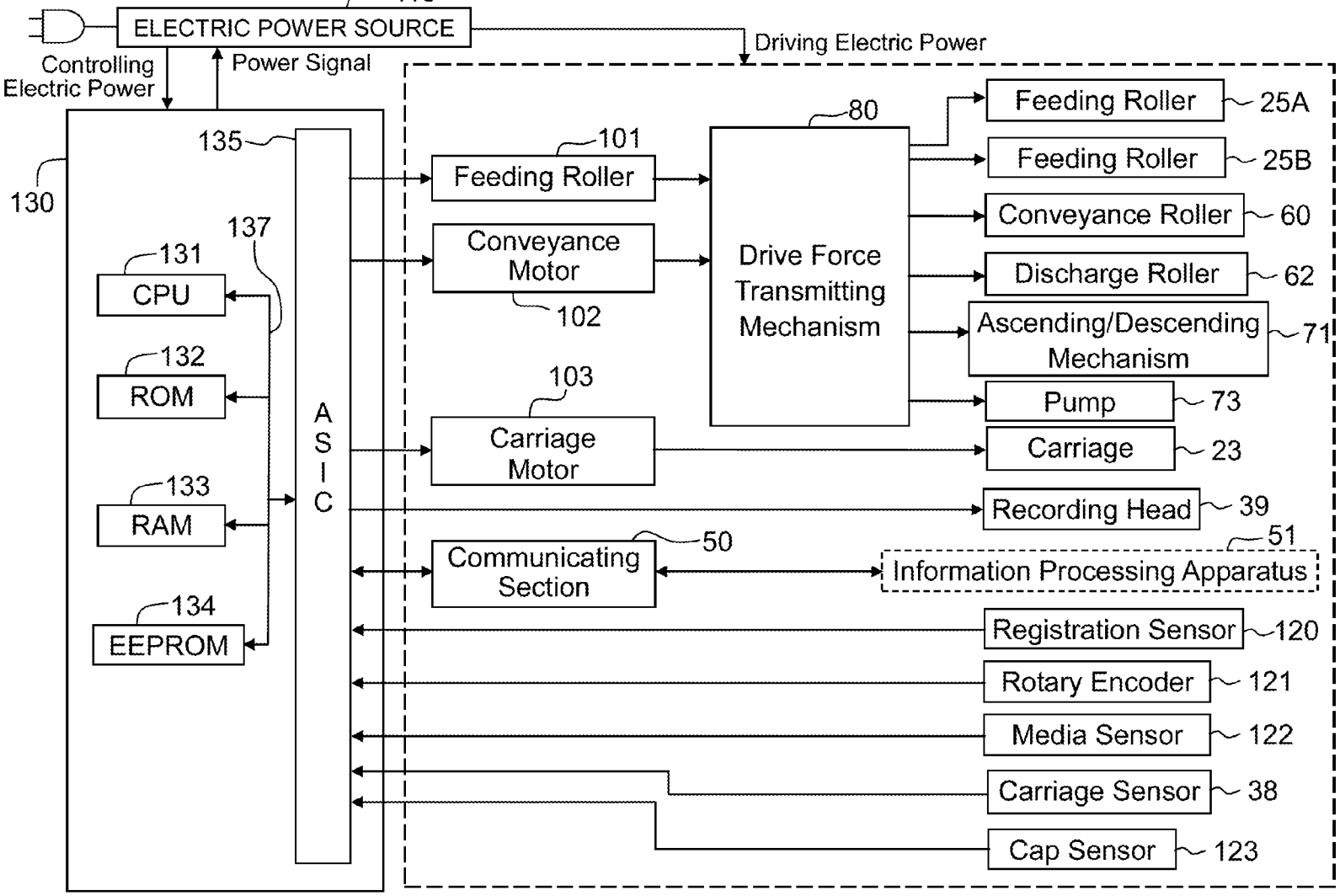
Fig. 6
ELECTRIC POWER SOURCE
110
Driving Electric Power
Power Signal
Controlling Electric Power
130
135
137
A S I C
CPU
131
ROM
132
RAM
133
EEPROM
134
Feeding Roller
101
Conveyance Motor
102
Carriage Motor
103
Communicating Section
50
Drive Force Transmitting Mechanism
80
Feeding Roller
25A
Feeding Roller
25B
Conveyance Roller
60
Discharge Roller
62
Ascending/Descending Mechanism
71
Pump
73
Carriage
23
Recording Head
39
Information Processing Apparatus
51
Registration Sensor
120
Rotary Encoder
121
Media Sensor
122
Carriage Sensor
38
Cap Sensor
123

INK-JET PRINTER

CROSS REFERENCE TO RELATED APPLICATION

The present application claims priority from Japanese Patent Application No. 2016-149566 filed on Jul. 29, 2016 the disclosure of which is incorporated herein by reference in its entirety.

BACKGROUND

Field of the Invention

The present invention relates to an ink-jet recording apparatus configured to record an image, etc. on a sheet, in accordance with a recording command received from an information processing apparatus via a communication network.

Description of the Related Art

Conventionally, there is made an attempt, in an information processing apparatus and a printer which are connected to each other via a communication network, to shorten FPOT (abbreviation of "First Print Out Time") that is a time since a print instruction or command is input to an external apparatus until a first sheet is discharged from the printer.

In order to shorten the FPOT, there is known a printer configured to execute a pre-print preparing processing, under a condition that the printer receives a pre-print notification from a host, and configured to execute a print processing under a condition that the printer receives a print data from the host. Note that the pre-print preparing processing includes, for example, a flushing processing for causing a recording head to jet or discharge an ink toward an ink receiving section, etc. The term "flushing processing" means a processing for jetting an ink which is dried inside the recording head so as to secure a predetermined quality in the image recording (image recording quality).

However, if a time after the execution of the flushing preparation in the pre-print preparing processing until the receipt of the print data were long, there is such a possibility that the ink inside the recording head might be dried again and that any predetermined image recording quality might not be secured. On the other hand, if the flushing processing were always executed every time the print data is received, the effect of shortening the FPOT would be limiting.

The present teaching has been made in view of the above-described situation, and an object of the present teaching is to provide an ink-jet recording apparatus capable of shortening the FPOT while maintaining the image recording quality.

SUMMARY

According to an aspect of the present teaching, there is provided an ink-jet printer configured to jet ink droplets toward a sheet, including:

a conveyer configured to convey the sheet in a conveyance direction;

a recording head having a plurality of nozzles and configured to jet the ink droplets from the plurality of nozzles toward the sheet conveyed by the conveyer;

an ink receiver;

a communicating interface; and a controller configured to control the conveyer, the recording head and the communicating interface, wherein under a condition that the controller receives, from an information processing apparatus via the communicating interface, a preceding command notifying transmittance of a recording command which is an instruction for recording an image on the sheet, the controller is configured to control the recording head to execute a first flushing processing in which the recording head jets the ink droplets from the plurality of nozzles toward the ink receiver; and under a condition that an elapsed time, elapsed after completion of the first flushing processing is not less than a threshold time, and that the controller receives the recording command from the information processing apparatus via the communicating interface, the controller is configured to control the recording head to execute:

a second flushing processing in which the recording head jets the ink droplets from the plurality of nozzles toward the ink receiver, and a recording processing in which the recording head jets the ink droplets from the plurality of nozzles toward the sheet conveyed by the conveyer up to the sheet facing area, under a condition that the second flushing processing has been completed, and under a condition that the elapsed time is less than the threshold time, and that the controller receives the recording command from the information processing apparatus via the communicating interface, the controller is configured to control the recording head to execute the recording processing without executing the second flushing processing.

According to the above-described configuration, in a case that the elapsed time elapsed since the completion of the first flushing processing is long, the recording processing is executed after the execution of the second flushing processing. Thus, it is possible to secure the image recording quality. Also in this case, the FPOT is already long at a point of time when the recording command is received, and thus the effect caused by the increase in the FPOT by the second flushing processing is relatively small. On the other hand, in a case that the elapsed time is short, the recording processing is executed while omitting the second flushing processing, thereby making it possible to shorten the FPOT. Also note that in this case, the time from the completion of the first flushing processing until the start of the recording processing is short, and thus it is also possible to suppress any lowering in the image recording quality.

According to the present teaching, the recording processing is executed after the second flushing processing in a case that the elapsed time is long, whereas the recording processing is executed while skipping the second flushing processing in another case that the elapsed time is short. Accordingly, it is possible to shorten the FPOT while maintaining the image recording quality.

BRIEF DESCRIPTION OF THE DRAWINGS

FIGS. 5A, 5B and 5C are each a view schematically depicting the configuration of a switching mechanism 170, wherein FIG. 5A depicts a first state, FIG. 5B depicts a second state, and FIG. 5C depicts a third state of the switching mechanism 170.

FIG. 6 is a block diagram of the multi-function peripheral 10.

FIGS. 10A to 10C are each a view depicting the positional relationship between the carriage 23 and the ink receiving section 75, wherein FIG. 10A depicts a state that the carriage 23 is located on the left side relative to the ink receiving section 75, FIG. 10B depicts a state that the carriage 23 is moving, with a position at which the carriage 23 faces the ink receiving section 75 being located on the right side relative to the carriage 23, and FIG. 10C depicts a state that the carriage 23 is located on the right side relative to the ink receiving section 75 (and/or that the carriage 23 is moving leftwardly relative to the ink receiving section 75).

DESCRIPTION OF THE EMBODIMENTS

Figure 1:
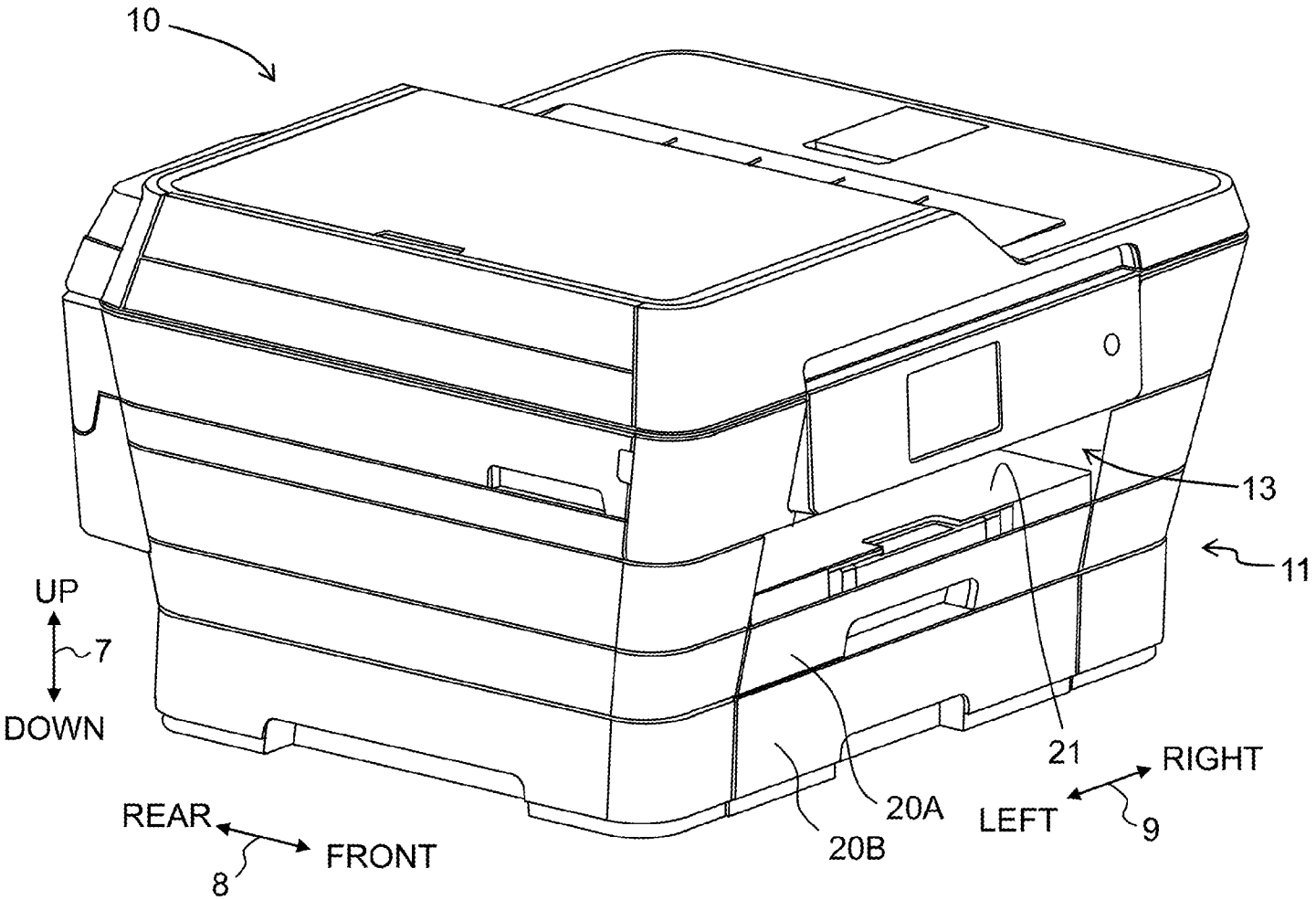
FIG. 1 is a perspective view depicting the outer appearance of a multi-function peripheral 10.

In the following, an embodiment of the present teaching will be described, with reference to the drawings. Note that, however, the embodiment explained below is merely an example of the present teaching; it goes without saying that it is possible to make any appropriate change(s) in the embodiment of the present teaching without departing from the gist and/or scope of the present teaching. Further, in the following explanation, a state in which a multi-function peripheral 10 is usably installed (a state as depicted in FIG. 1) will be referred to as a "usable state", in some cases. An up-down direction 7 is defined with the "usable state" as the reference. Further, a front-rear direction 8 is defined, with a side on which an opening 13 of the multi-function peripheral 10 is provided is designated as the frontward side (front surface or front side), and a left-right direction 9 is defined as viewing the multi-function peripheral 10 from the frontward side (front surface).

<Overall Configuration of Multi-Function Peripheral 10>

As depicted in FIG. 1, the multi-function peripheral 10 is formed to have a substantially rectangular parallelepiped shape. The multi-function peripheral 10 includes a printer 11. The multi-function peripheral 10 is an example of an ink-jet recording apparatus. Further, the multi-function peripheral 10 may further include, for example, a scanner which is configured to read an original (a manuscript) and to generate an image data of an image in the original; etc.

<Printer 11>

Figure 2:
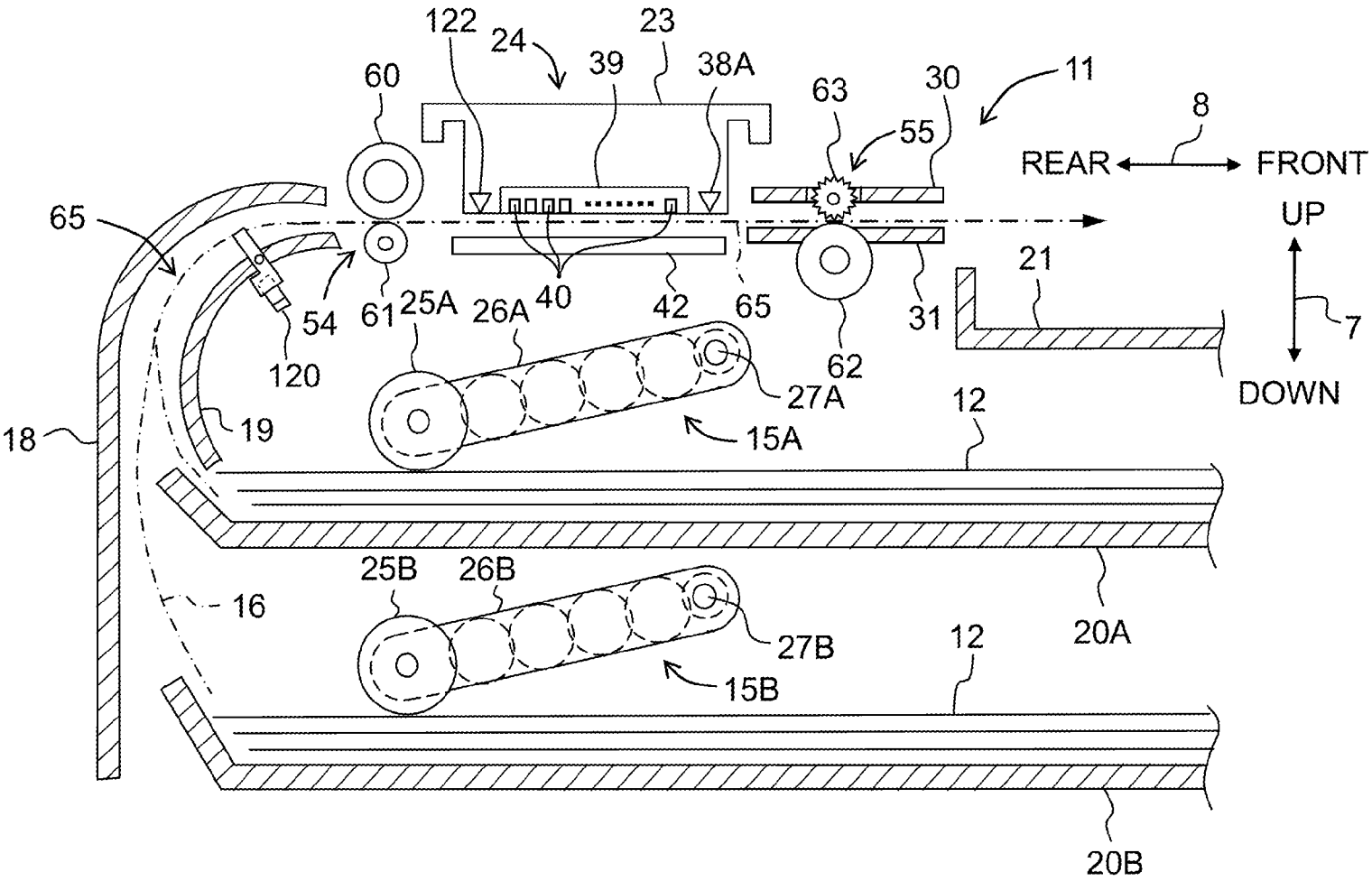
FIG. 2 is a vertical cross-sectional view schematically depicting the internal structure of a printer 11.

The printer 11 records an image, indicated by the image data, on a sheet 12 (see FIG. 2) by jetting (discharging) an ink onto the sheet 12. Namely, the printer 11 adopts a so-called ink-jet recording system. As depicted in FIG. 2, the printer 11 is provided with feeding sections 15A and 15B, feed trays 20A and 20B, a discharge tray 21, a conveyance roller section 54, a recording section 24, a discharge roller section 55, and a platen 42. The conveyance roller section 54 and the discharge roller section 55 are an example of a conveyer.

<Feed Trays 20A and 20B, Discharge Tray 21>

The opening 13 (see FIG. 1) is formed in the front surface of the printer 11. The feed trays 20A and 20B are inserted into or removed from the printer 11 in the front-rear direction 8 through the opening 13. The feed trays 20A and 20B each support a plurality of pieces of the sheet 12 that are stacked in the feed tray 20A, 20B. The discharge tray 21 supports the sheet 12 discharged by the discharge roller section 55 via the opening 13.

<Feeding Sections 15A and 15B>

As depicted in FIG. 2, the feeding section 15A includes a feeding roller 25A, a feeding arm 26A, and a shaft 27A. The feeding roller 25A is rotatably supported by the feeding arm 26A at a front end thereof. The feeding arm 26A is pivotably supported by the shaft 27A supported by a frame of the printer 11. The feeding arm 26A is urged toward the feeding tray 20A by a bias which is applied thereto by an elastic force of a spring or by the self-weight of the feeding arm 26A such that the feeding arm 26A is pivoted toward the feed tray 20A. The feeding section 15B includes a feeding roller 25B, a feeding arm 26B, and a shaft 27B. Since the specific construction of the feeding section 15B is common with that of the feeding section 15A, the explanation therefor will be omitted. The feeding section 15A feeds, with the feeding roller 25A, a sheet 12 supported by the feed tray 20A to a conveyance route 65. The feeding roller 25A is rotated by a driving force generated by the rotation of a feeding motor 101 (see FIG. 6) in a normal direction and transmitted to the feeding roller 25A. The feeding section 15B feeds, with the feeding roller 25B, a sheet 12 supported by the feed tray 20B to the conveyance route 65. The feeding roller 25B is rotated by a driving force generated by the rotation of the feeding motor 101 in the normal direction and transmitted to the feeding roller 25B.

<Conveyance Route 65>

The conveyance route 65 means a space defined by guide members 18 and 30 and guide members 19 and 31. The guide member 18 and the guide member 19 face with each other with a predetermined interval (gap) intervened therebetween and the guide member 30 and the guide member 31 face with each other with a predetermined interval (gap) intervened therebetween, in the interior of the printer 11. The conveyance route 65 is a route or path which extends from rear-end portions of the feed trays 20A and 20B toward the rear side of the printer 11. Further, the conveyance route 65 makes a U-turn frontwardly while extending from the lower side to the upper side, at the rear side of the printer 11; and then the conveyance route 65 reaches the discharge tray 21 via the recording section 24. Note that a conveyance direction 16 in which the sheet 12 is conveyed inside the conveyance route 65 is indicated by an arrow of a dot-dash chain line in FIG. 2.

<Conveyance Roller Section 54>

The conveyance roller section 54 is arranged on the upstream side of the recording section 24 in the conveyance direction 16 (arranged upstream of the recording section 24 in the conveyance direction 16). The conveyance roller section 54 includes a conveyance roller 60 and a pinch roller 61 which are facing each other. The conveyance roller 60 is driven by a conveyance motor 102 (see FIG. 6).

The pinch roller 61 rotates following the rotation of the conveyance roller 60. The sheet 12 is conveyed in the conveyance direction 16 by being pinched between the conveyance roller 60 and the pinch roller 61. In this situation, the conveyance roller 60 is rotated in the normal direction (rotated normally or positively) by being transmitted with a driving force generated by the rotation of the conveyance motor 102 in the normal direction, and conveys the sheet 12 in the conveyance direction 16 while pinching the sheet 12 between the conveyance roller 60 and the pinch roller 61. Further, the conveyance roller 60 rotates in a reverse direction, which is reverse to that of the normal rotation, by being transmitted with a driving force generated by the rotation of the conveyance motor 102 in the reverse direction.

<Discharge Roller Section 55>

The discharge roller section 55 is arranged at the downstream side of the recording section 24 in the conveyance direction 16. The discharge roller section 55 includes a discharge roller 62 and a spur 63 which are facing each other. The discharge roller 62 is driven by the conveyance motor 102. The spur 63 rotates following the rotation of the discharge roller 62. The sheet 12 is conveyed in the conveyance direction 16 by being pinched between the discharge roller 62 and the spur 63. In this situation, the discharge roller 62 is rotated in the normal direction by being transmitted with the driving force generated by the rotation of the conveyance motor 102 in the normal direction, and conveys the sheet 12 in the conveyance direction 16 while pinching the sheet 12 between the discharge roller 62 and the spur 63.

<Registration Sensor 120>

As depicted in FIG. 2, the printer 11 is provided with a registration sensor 120. The registration sensor 120 is arranged upstream of the conveyance roller section 54 in the conveyance direction 16. The registration sensor 120 outputs different detection signals, depending on whether or not the sheet 12 is present at a setting position. Under a condition that the sheet 12 is present at the setting position, the registration sensor 120 outputs a HIGH level signal to a controller 130 (to be described later on; see FIG. 6). On the other hand, under a condition that the sheet 12 is not present at the setting position, the registration sensor 120 outputs a LOW level signal to controller 130.

<Rotary Encoder 121>

As depicted in FIG. 6, the printer 11 is provided with a rotary encoder 121 which is configured to generate a pulse signal depending on the rotation of the conveyance roller 60 (in other words, the rotary driving of the conveyance motor 102). The rotary encoder 121 is provided with an encoder disc and an optical sensor. The encoder disc rotates together with the rotation of the conveyance roller 60. The optical sensor reads the rotating encoder disc so as to generate a pulse signal, and outputs the generated pulse signal to the controller 130.

<Recording Section 24>

As depicted in FIG. 2, the recording section 24 is arranged between the conveyance roller section 54 and the discharge roller section 55 in the conveyance direction 16. Further, the recording section 24 is arranged to face the platen 42 in the up-down direction 7. Furthermore, the recording section 24 includes a carriage 23, a recording head 39, an encoder sensor 38A and a media sensor 122. Further, as depicted in FIG. 3, an ink tube 32 and a flexible flat cable 33 are connected to the carriage 23.

The ink tube 32 connects the recording head 39 with a non-illustrated installment section. The installment section is configured such that an ink cartridge is detachable and attachable with respect to the installment section. An ink stored in the ink cartridge installed in the installment section is supplied to the recording head 39 via the ink tube 32. Note that, however, the ink is not being limited to or restricted by being stored in the ink cartridge which is attached/detached with respect to the installment section, and the ink may be stored in an ink tank fixed to the casing of the multi-function peripheral 10. The flexible flat cable 33 electrically connects the recording head 39 to a control circuit board having the controller 130 mounted thereon.

Figure 3:
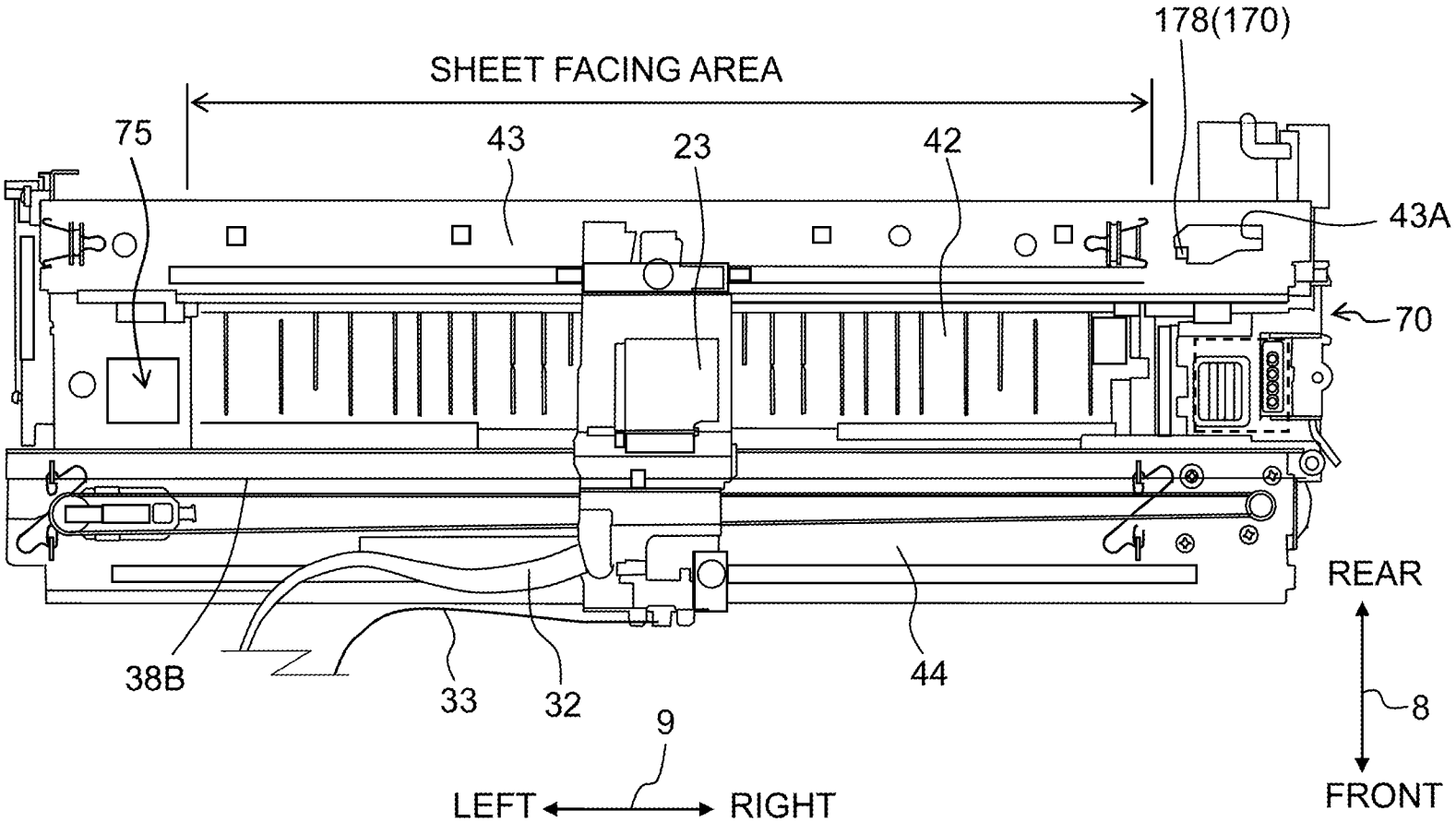
FIG. 3 is a plane view of a carriage 23 and guide rails 43 and 44.

As depicted in FIG. 3, the carriage 23 is supported by guide rails 43 and 44 which are extended respectively in the left-right direction 9, at positions separated respectively in the front-rear direction 8. The carriage 23 is connected to a known belt mechanism disposed on the guide rail 44. Note that the belt mechanism is driven by a carriage motor 103 (see FIG. 6). Namely, the carriage 23, connected to the belt mechanism which circumferentially moves in the left-right direction 9 by being driven by the carriage motor 103, is capable of reciprocating in the left-right direction 9. The left-right direction 9 is an example of a main scanning direction.

As depicted in FIG. 2, the recording head 39 is installed (mounted) on the carriage 23. A plurality of nozzles 40 is formed in the lower surface of the recording head 39 (in the following description, the lower surface of the recording head 39 will be referred to as a "nozzle surface"). The recording head 39 is provided with a vibrating element such as a piezoelectric element. The piezoelectric element is vibrated to thereby jet or discharge an ink droplet of an ink through each of the nozzles 40. In a process during which the carriage 23 is moved, the recording head 39 jets the ink droplets toward the sheet 12 supported by the platen 42. Accordingly, an image, etc. is recorded on the sheet 12.

The vibrating element is an example of a jetting energy-generating element which generates, from driving voltage applied by an electric power source 110 (see FIG. 6), an energy for causing the ink droplet to be jetted from the nozzle 40 (namely, the vibrational energy). Note that, however, the specific example of the jetting-energy generating element is not limited to the vibrational element, and may be, for example, a heater which generates thermal energy. Further, the heater may heat the ink by thermal energy generated from a driving voltage applied by the electrical power source 110, and may cause an ink droplet, which is foamed by being heated, to be jetted from the nozzle. Furthermore, although the recording head 39 according to the present embodiment jets a pigment ink, the recording head 39 may jet a dye ink, as well.

Moreover, the recording head 39 may jet, for example, a main droplet and a satellite droplet (of an ink) from a nozzle 40. The main droplet and the satellite droplet are such droplets which are separate liquid (ink) droplets at a stage at which the main and satellite droplets are jetted from the nozzle 40, which are joined in the air and land on a substantially same position in the sheet, and which form one dot on the sheet. In the present specification, the unit of the ink forming one dot on the sheet is expressed as "one droplet" or "one shot". Namely, in "FLS shot count" which will be described later, a main droplet and a satellite droplet which land on a substantially same position on a sheet are collectively or inclusively counted as one shot.

The plurality of nozzles 40 are arranged in rows in the front-rear direction 8 and the left-right direction 9, as depicted in FIGS. 2 and 4. Nozzles 40 included in the plurality of nozzles 40 and arranged to form a row in the front-rear direction 8 (hereinafter referred to as a "nozzle row") jet ink droplets of a same color. The nozzle surface is formed with 24 nozzle rows which are arranged in the left-right direction 9. Further, every six adjacent nozzle rows, among the 24 nozzle rows, jet a same color ink. In the present embodiment, six nozzle rows from the right end jet ink droplets of a black ink, another six nozzle rows adjacent to the six nozzle rows jet ink droplets of a yellow ink, yet another six nozzle rows adjacent to the another six nozzle rows jet ink droplets of a cyan ink, and still yet another six nozzle rows from the left end jet ink droplets of a magenta ink. Note that, however, the number of the nozzle row and the combination of colors of inks to be jetted are not limited to the above-described examples.

Further, an encoder strip 38B, which has a band-shape and which extends in the left-right direction 9, is arranged on the guide rail 44, as depicted in FIG. 3. The encoder sensor 38A is mounted on the lower surface of the carriage 23 at a position at which the encoder sensor 38A faces the encoder strip 38B. In a process in which the carriage 23 is moved, the encoder sensor 38A reads the encoder strip 38B to thereby generate a pulse signal, and outputs the generated pulse signal to the controller 130. The encoder sensor 38A and the encoder strip 38B construct a carriage sensor 38 (see FIG. 6).

<Media Sensor 122>

As depicted in FIG. 2, the media sensor 122 is mounted on the carriage 23 at the lower surface (surface facing the platen 42) of the carriage 23. The media sensor 122 is provided with a light-emitting section and a light-receiving section. The light-emitting section is exemplified by a light emitting diode, etc.; and the light-receiving section is exemplified by an optical sensor, etc. The light emitting section irradiates a light at a light amount instructed by the controller 130 toward the platen 42. The light irradiated from the light emitting section is reflected by the platen 42 or a sheet 12 supported by the platen 42, and the reflected light is received by the light receiving section. The media sensor 122 outputs, to the controller 130, a detection signal depending on a light receiving amount in the light receiving section. For example, as the light receiving amount is greater, the media sensor 122 outputs a detection signal of higher level to the controller 130.

<Platen 42>

As depicted in FIG. 2, the platen 42 is arranged between the conveyance roller section 54 and the discharge roller section 55 in the conveyance direction 16. The platen 42 is arranged so as to face the recording section 24 in the up-down direction 7, and supports the sheet 12, conveyed by at least one of the conveyance roller section 54 and the discharge roller section 55, from therebelow. The light reflectance of the platen 42 in the present embodiment is set to be lower than that of the sheet 12.

<Maintenance Mechanism 70>

As depicted in FIG. 3, the printer 11 is further provided with a maintenance mechanism 70. The maintenance mechanism 70 is configured to perform maintenance for the recording head 39. More specifically, the maintenance mechanism 70 executes a purge operation of sucking an ink inside the nozzles 40, air inside the nozzles 40, and any foreign matter or substance adhered to the nozzle surface. The ink inside the nozzles 40, the air inside the nozzles 40 and any foreign matter or substance adhered to the nozzle surface which are sucked and removed by the maintenance mechanism 70 are stored in a waste liquid tank 74 (see FIG. 4A).

As depicted in FIG. 3, the maintenance mechanism 70 is arranged at a location which is shifted (deviated) on one side (on the right side, rightward) in the main scanning direction relative to the sheet facing area. The term "sheet facing area" means an area in the main scanning direction in which an object such as the carriage 23 may face a sheet 12 conveyed by the conveyer. The maintenance mechanism 70 is provided with a cap 71, a tube 72 and a pump 73, as depicted in FIG. 4A.

The cap 71 is constructed of a rubber. In a case that the carriage 23 is located at a first position shifted on the right side in the main scanning direction relative to the sheet facing area, the cap 71 is located at a position at which the cap 71 faces the recording head 39 mounted on the carriage 23. The tube 72 reaches the waste liquid tank 74 from the cap 71 and via the pump 73. The pump 73 is, for example, a tube pump of a rotary system. The pump 73 is driven by the conveyance motor 102 to thereby suck the ink inside the nozzles 40, the air inside the nozzles 40 and any foreign matter or substance adhered to the nozzle surface via the cap 71 and the tube 72, and to discharge the sucked ink inside the nozzles 40, air inside the nozzles 40 and any foreign matter or substance adhered to the nozzle surface to the waste liquid tank 74 via the tube 72.

The cap 71 is constructed, for example, to be movable between a covering position and a separate position which are separate and away in the up-down direction 7. The cap 71 located at the covering position makes tight contact with the recording head 39 mounted on the carriage 23 which is located at the first position, and covers the nozzle surface. On the other hand, the cap at the separate position is separated and away from the nozzle surface. The cap 71 is movable between the covering position and the separate position by an ascending/descending mechanism (elevator) 71A (see FIG. 6) which is driven by the feeding motor 101. Note that, however, the specific configuration for moving the cap 71 closer relative to the recording head and for separating the cap 71 relative to the recording head 39 is not limited to the above-described example.

As another example, it is allowable that the cap 71 is moved by a non-illustrated link mechanism which operates accompanying with the movement of the carriage 23, instead of being moved by the ascending/descending mechanism driven by the feeding motor 101. The posture of the link mechanism is changeable from a first posture in which the link mechanism holds the cap 71 at the covering position, and a second posture in which the link mechanism holds the cap 71 at the separate position. For example, in a case that the link mechanism is contacted by (is brought into contact with) the carriage 23 moving (rightwardly) toward the first position, the posture of the link mechanism is changed from the second posture into the first posture. On the other hand, for example, in a case that the carriage 23 moving (leftwardly) toward a second position is separated from the link mechanism, the posture of the link mechanism is changed from the first posture into the second posture.

As still another example, it is allowable that the multi-function peripheral 10 is provided with an ascending/descending mechanism which moves the guide rails 43 and 44 in the up-down direction 7, instead of the mechanism which moves the cap 71. Namely, the carriage 23 at the first position is ascended/descended together with the guide rails 43 and 44 which are ascended/descended by the ascending/descending mechanism. On the other hand, the cap 71 is fixed to a position at which the cap 71 faces the recording head 39 mounted on the carriage 23 which is located at the first position. Further, the guide rails 43 and 44 and the carriage 23 are lowered (descended) to a predetermined position by the ascending/descending mechanism, thereby allowing the nozzle surface of the recording head 39 to be covered by the cap 71. On the other hand, the guide rails 43 and 44 and the carriage 23 are lifted or ascended to another predetermined position by the ascending/descending mechanism, thereby allowing the recording head 39 and the cap 71 to be separated away from each other, and allowing the carriage 23 to be movable in the main scanning direction.

As yet another example, it is allowable that the multi-function peripheral 10 is provided with both the ascending/descending mechanism which moves the cap 71 and the ascending/descending mechanism which moves the guide rails 43 and 44. Further, it is allowable that the carriage 23 and the cap 71 are moved in directions, respectively, such that the carriage 23 and the cap 71 approach closely to each other, thereby bringing the cap 71 into a tight contact with the nozzle surface. Furthermore, it is allowable that the carriage 23 and the cap 71 are moved in directions, respectively, such that the carriage 23 and the cap 71 are separated away from each other, thereby allowing the cap 71 to be separated away from the nozzle surface. Namely, the above-described covering position and separate position are a relative position of the cap 71 relative to the recording head 39. Further, by moving one or both of the recording head 39 and the cap 71, the relative position of the cap 71 relative to the recording head 39 may be changed. In other words, by moving the recording head 39 and the cap 71 relative to each other, the relative position of the cap 71 relative to the recording head 39 may be changed.

<Cap Sensor 123>

The printer 11 is further provided with a cap sensor 123, as depicted in FIG. 6. The cap sensor 123 outputs different detection signals, depending on whether or not the cap 71 is located at the covering position. Under a condition that the cap 71 is located at the covering position, the cap sensor 123 outputs a HIGH level signal to the controller 130. On the other hand, under a condition that the cap 71 is located at a position different from the covering position, the cap sensor 123 outputs a LOW level signal to controller 130. Note that in a case that the cap 71 is moved from the covering position to the separate position, the detection signal outputted from the cap sensor 123 changes from the HIGH level signal to the LOW level signal before the cap 71 reaches the separate position.

<Ink Receiving Section 75>

As depicted in FIG. 3, the printer 11 is further provided with an ink receiving section 75. The ink receiving section 75 is arranged at a location which is shifted on the other side (left side, leftward) in the main scanning direction relative to the sheet facing area. More specifically, in a case that the carriage 23 is located on the second position which is different from the first position and which is shifted on the left side in the main scanning direction relative to the sheet facing area, the ink receiving section 75 is arranged at a position (location) at which the ink receiving section 75 faces the recording head 39 mounted on the carriage 23. Note that it is allowable that the maintenance mechanism 70 and the ink receiving section 75 are arranged on a same side in the main scanning direction, relative to the sheet facing area. Note that, however, the first position and the second positions are positions which are separate and away from each other in the main scanning direction.

Figure 4B:
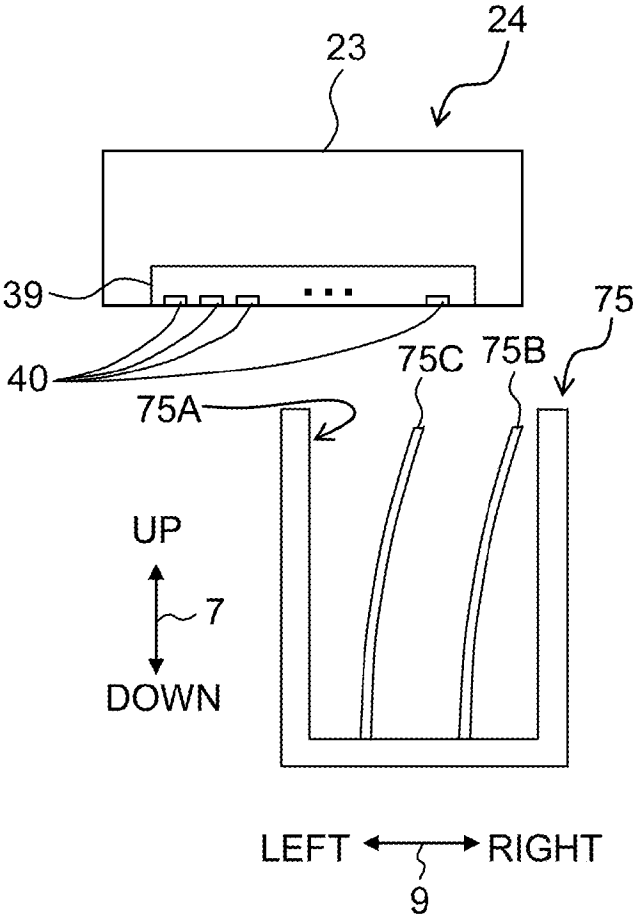
FIG. 4B is a view schematically depicting the configuration of an ink receiving section 75.
Figure 4A:
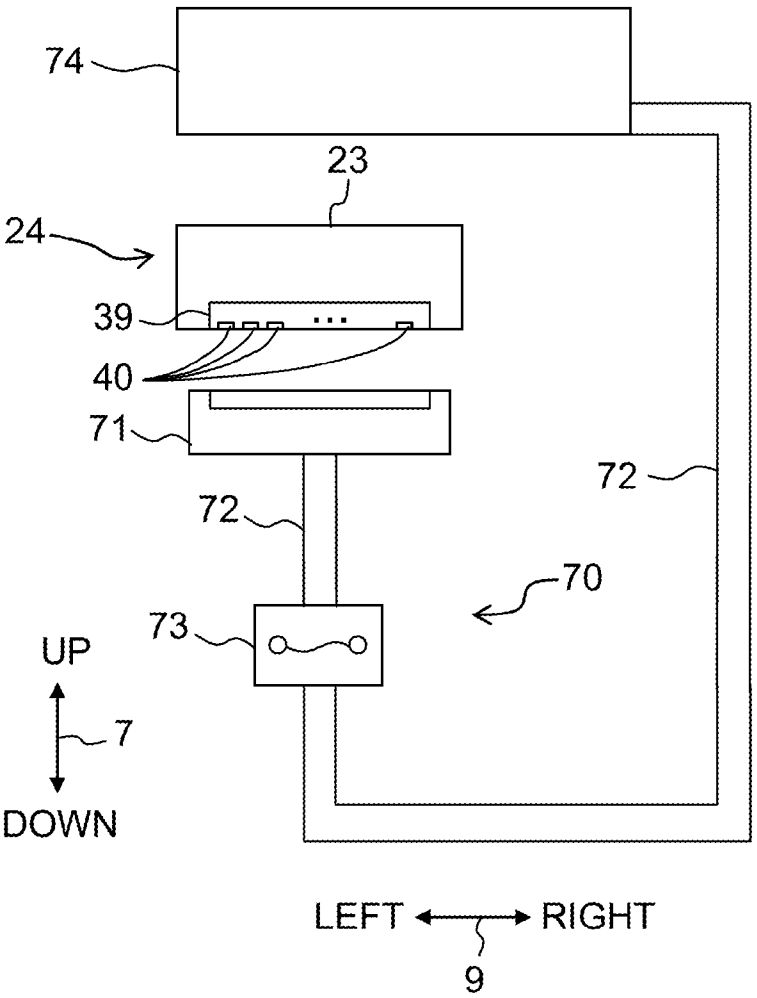
FIG. 4A is a view schematically depicting the configuration of a maintenance mechanism 70.

As depicted in FIG. 4B, the ink receiving section 75 has a box-shape which is substantially rectangular parallelepiped and which has an opening 75A formed in the upper surface thereof. The width in the main scanning direction of the opening 75A is shorter than the width in the main scanning direction of the nozzle surface. Further, guide plates 75B and 75B are arranged inside the ink receiving section 75, at locations apart in the left-right direction 9, respectively. The guide plates 75B and 75C are each a plate-shaped member spreading in the up-down direction 7 and the front-rear direction 8. Further, the guide plates 75B and 75C are disposed such that each of the guide plates 75B and 75C is inclined in the left-right direction 9. More specifically, the guide plates 75B and 75C are arranged inside the ink receiving section 75 such that the left surface of each of the guide plates 75B and 75C faces (is oriented) in a left obliquely upward direction. Each of the guide plates 75B and 75C guides an ink droplet jetted from the recording head 39 toward the back surface (bottom surface) of the ink receiving section 75. Note that, however, the number of the guide plates 75B, 75C is not limited to 2 (two).

<Driving Force Transmitting Mechanism 80>

As depicted in FIG. 6, the printer 11 is further provided with a driving force transmitting mechanism 80. The driving force transmitting mechanism 80 is configured to transmit the driving forces generated by the feeding motor 101 and the conveyance motor 102 to the feeding rollers 25A, 25B, the conveyance roller 60, the discharge roller 62, the ascending/descending mechanism 71A for the cap 71, and the pump 73. The driving force transmitting mechanism 80 is constructed by combining all or a part of: a gear, a pulley, an endless annular belt, a planetary gear mechanism (pendulum gear mechanism), a one-way clutch, and the like. Further, the driving force transmitting mechanism 80 is provided with a switching mechanism 170 (see FIG. 5) configured to change a transmittance destination to which the driving forces generated by the feeding motor 101 and the conveyance motor 102 are transmitted.

<Switching Mechanism 170>

As depicted in FIG. 3, the switching mechanism 170 is arranged on a position shifted on one side in the main scanning direction relative to the sheet facing area. Further, the switching mechanism 170 is arranged to a location below the guide rail 43. As depicted in FIG. 5, the switching mechanism 170 is provided with a sliding member 171, driving gears 172 and 173, gears 174, 175, 176 and 177, a lever 178 and springs 179 and 180 each of which is provided as an example of an urging member. The switching mechanism 170 is configured such that the state thereof is switchable to (among) a first state, a second state and a third state.

The first state is such a state that the driving force of the feeding motor 101 is transmitted to the feeding roller 25A, but not transmitted to the feeding roller 25B and the ascending/descending mechanism 71A for the cap 71. The second state is such a state that the driving force of the feeding motor 101 is transmitted to the feeding roller 25B, but not transmitted to the feeding roller 25A and the ascending/descending mechanism 71A for the cap 71. The third state is such a state that the driving force of the feeding motor 101 is transmitted to the ascending/descending mechanism 71A for the cap 71, but not transmitted to the feeding roller 25A and the feeding roller 25B. Further, each of the first state and the second state is also such a state that the driving force of the conveyance motor 102 is transmitted to the conveyance roller 60 and the discharge roller 62, but not transmitted to the pump 73. The third state is also such a state that the driving force of the conveyance motor 102 is transmitted to all of the conveyance roller 60, the discharge roller 62, and the pump 73.

The sliding member 171 is a substantially columnar-shaped member which is supported by a supporting shaft (indicated in broken lines in FIG. 5) extending in the left-right direction 9. Further, the sliding member 171 is configured to be slidable in the left-right direction 9 along the supporting shaft. Furthermore, the sliding member 171 supports the driving gears 172 and 173 such that the driving gears 172 and 173 are rotatable independently from each other at locations, on the outer surface of the sliding member 171, which are shifted or separated from each other in the left-right direction 9. Namely, the sliding member 171 and the driving gears 172 and 173 make a sliding movement in the left-right direction 9 as an integrated body.

Figure 5A:
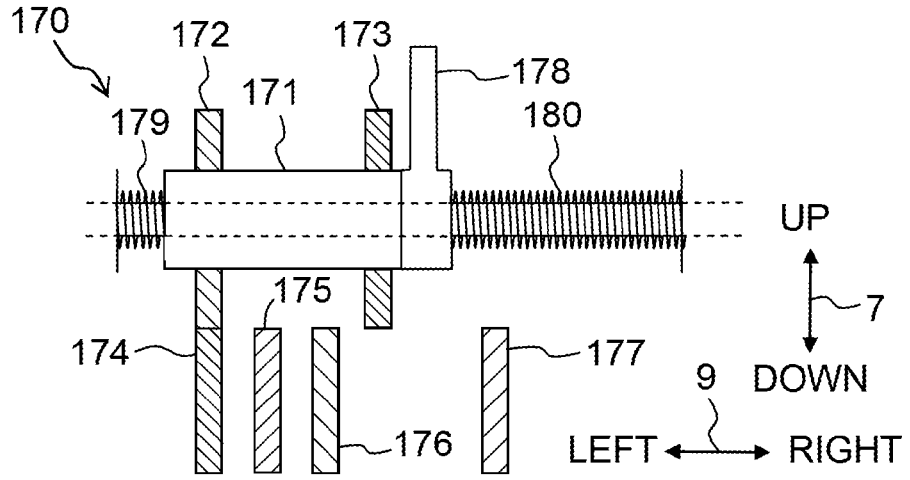
Figure 5B:
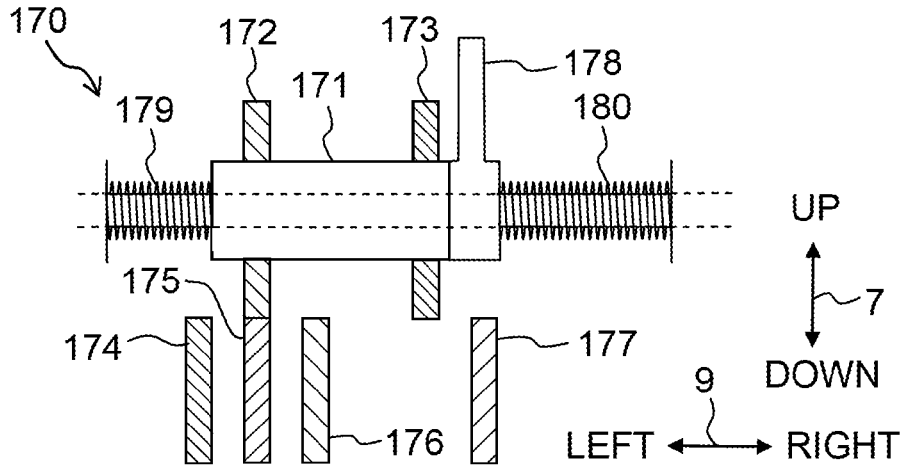
Figure 5C:
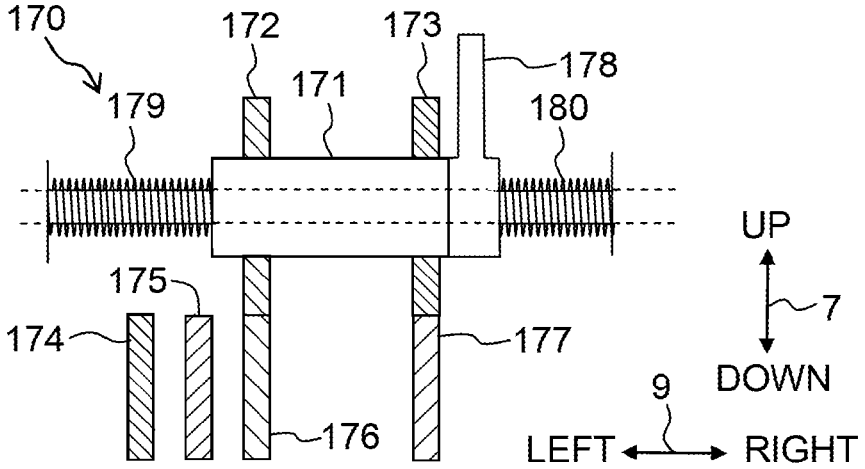
Figure 7:
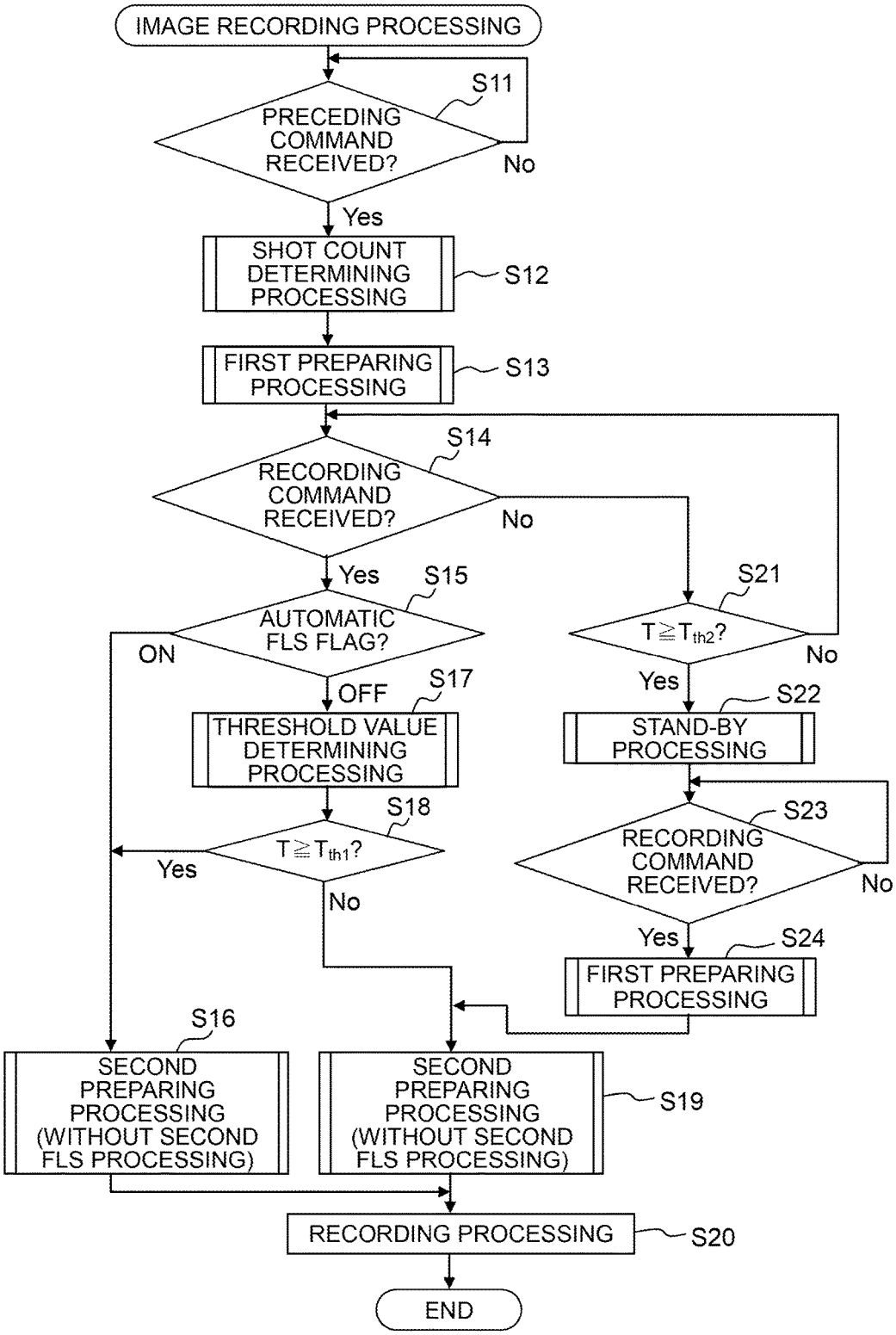
FIG. 7 is a flow chart of an image recording processing.
Figure 8B:
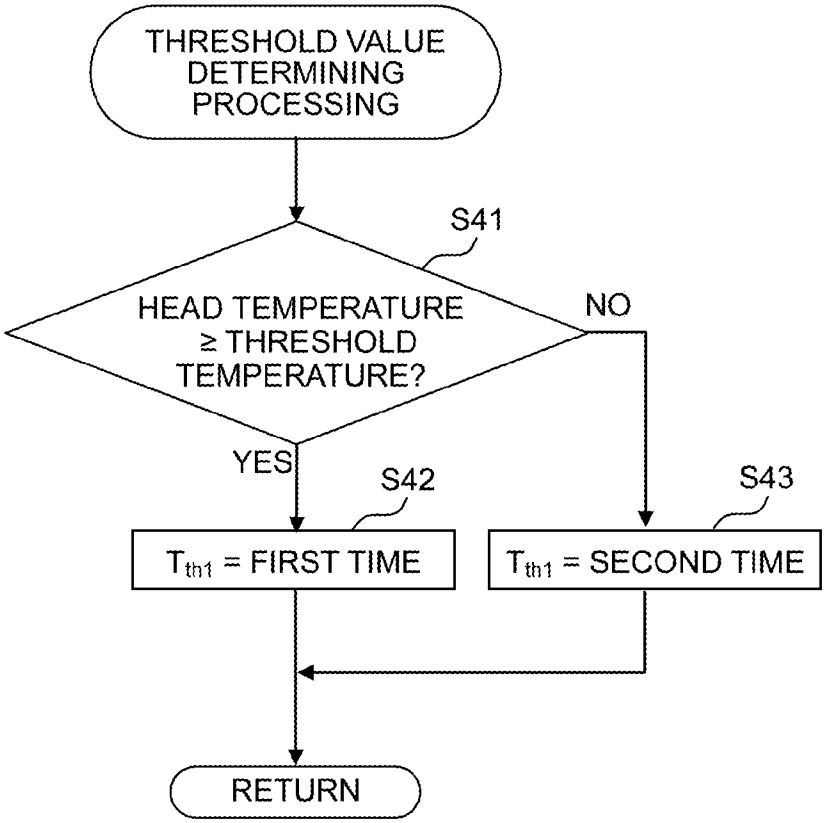
FIG. 8B is a flow chart of a threshold value determining processing.
Figure 8A:
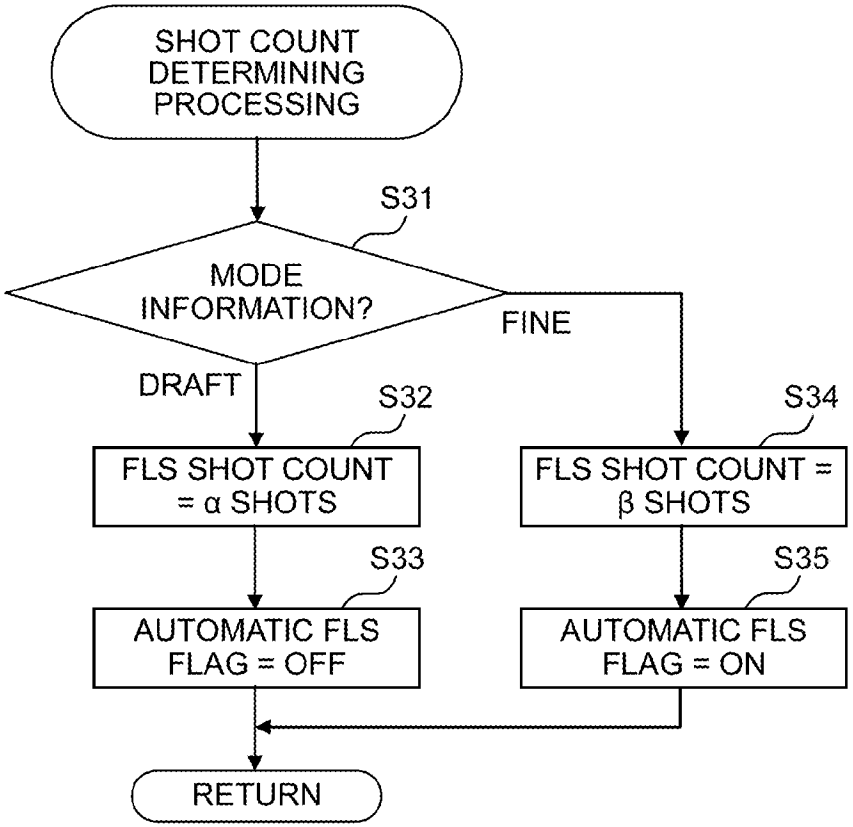
FIG. 8A is a flow chart of a shot count determining processing.

The driving gear 172 is rotated by the rotary driving force transmitted from the feeding motor 101 to the driving gear 172. The driving gear 172 meshes with one of the gears 174, 175 and 176. More specifically, in a case that the switching mechanism 170 is in the first state, the driving gear 172 meshes with the gear 174, as depicted in FIG. 5A. Further, in a case that the switching mechanism 170 is in the second state, the driving gear 172 meshes with the gear 175, as depicted in FIG. 5B. Furthermore, in a case that the switching mechanism 170 is in the third state, the driving gear 172 meshes with the gear 176, as depicted in FIG. 5C.

The driving gear 173 is rotated by the rotary driving force transmitted from the conveyance motor 102 to the driving gear 173. In a case that the state of the switching mechanism 170 is either one of the first state and the second state, the meshing of the driving gear 173 with the gear 176 is released, as depicted in FIGS. 5A and 5B. Further, in a case that the state of the switching mechanism 170 is the third state, the driving gear 173 meshes with the gear 177, as depicted in FIG. 5C.

The gear 174 meshes with a gear train rotating the feeding roller 25A. Namely, the rotary driving force of the feeding motor 101 is transmitted to the feeding roller 25A by the meshing of the driving gear 172 with the gear 174. Further, the rotary driving force of the feeding motor 101 is not transmitted to the feeding roller 25A due to the release of meshing of the driving gear 172 with the gear 174.

The gear 175 meshes with a gear train rotating the feeding roller 25B. Namely, the rotary driving force of the feeding motor 101 is transmitted to the feeding roller 25B by the meshing of the driving gear 172 with the gear 175. Further, the rotary driving force of the feeding motor 101 is not transmitted to the feeding roller 25B due to the release of meshing of the driving gear 172 with the gear 175.

The gear 176 meshes with a gear train driving the ascending/descending mechanism 71A for the cap 71. Namely, the rotary driving force of the feeding motor 101 is transmitted to the ascending/descending mechanism 71A for the cap 71 by the meshing of the driving gear 172 with the gear 176. Further, the rotary driving force of the feeding motor 101 is not transmitted to the ascending/descending mechanism 71A for the cap 71 due to the release of meshing of the driving gear 172 with the gear 176.

The gear 177 meshes with a gear train driving the pump 73. Namely, the rotary driving force of the conveyance motor 102 is transmitted to the pump 73 by the meshing of the driving gear 173 with the gear 177. Further, the rotary driving force of the conveyance motor 102 is not transmitted to the pump 73 due to the release of meshing of the driving gear 173 with the gear 177. On the other hand, the rotary driving force of the conveyance motor 102 is transmitted to the conveyance roller 60 and the discharge roller 62 not via the switching mechanism 170. Namely, the conveyance roller 60 and the discharge roller 62 are rotated by the rotary driving force transmitted thereto from the conveyance motor 102, regardless of the state of the switching mechanism 170.

The lever 178 is supported by the supporting shaft at a location adjacent to a right side portion of the sliding member 171. Further, the lever 178 is configured to be slidable in the left-right direction 9 along the supporting shaft. Furthermore, the lever 178 is projected upwardly. Moreover, a forward end (tip portion) of the lever 178 reaches up to a position at which the forward end is capable of contacting with the carriage 23, via an opening 43A (see FIG. 3) formed in the guide rail 43. The lever 178 is configured to be slidable in the left-right direction 9 by being contacted by the carriage 23 and by being separated from the carriage 23. Further, the switching mechanism 170 is provided with a plurality of locking sections configured to lock the lever 178. Accordingly, the lever 178, in a state of being locked by a locking section among the plurality of locking sections and being separated from the carriage 23 at a certain location, may remain at the certain location even after the lever 178 has been separated away from the carriage 23.

The springs 179 and 180 are supported by the supporting shaft. The spring 179 makes contact with the frame of the printer 11 at one end (left end) of the spring 179, and the spring 179 makes contact with the left end surface of the sliding member 171 at the other end (right end) of the spring 179. Namely, the spring 179 urges the sliding member 171 and the lever 178 contacting the sliding member 171 rightwardly. The spring 180 makes contact with the frame of the printer 11 at one end (right end) of the spring 180, and the spring 180 makes contact with the right end surface of the lever 178 at the other end (left end) of the spring 180. Namely, the spring 180 urges the lever 178 and the sliding member 171 contacting the lever 178 leftwardly. Further, the urging force of the spring 180 is greater than the urging force of the spring 179.

In a case that the lever 178 is locked by a first locking section included in the plurality of locking sections, the switching mechanism 170 is in the first state. Then, the lever 178, pushed or pressed by the carriage 23 moving rightwardly, moves rightwardly against the urging force of the spring 180, and is locked by a second locking section located on the right side with respect to the first locking section. With this, the sliding member 171 moves rightwardly, by the urging force of the spring 179, following the movement of the lever 178. As a result, the state of the switching mechanism 170 is changed from the first state depicted in FIG. 5A to the second state depicted in FIG. 5B. Namely, the lever 178 is contacted by the carriage 23 which is moving from the second position toward the first position to thereby switch the state of the switching mechanism 170 from the first state into the second state.

Further, the lever 178, pressed by the carriage 23 moving up to the first position, moves rightwardly against the urging force of the spring 180, and is locked by a third locking section located farther on the right side with respect to the second locking section. With this, the sliding member 171 moves rightwardly, by the urging force of the spring 179, following the movement of the lever 178. As a result, the state of the switching mechanism 170 is changed from the first state depicted in FIG. 5A or the second state depicted in FIG. 5B to the third state depicted in FIG. 5C. Namely, the lever 178 is contacted by the carriage 23 which is moving up to the first position to thereby switch the state of the switching mechanism 170 into the third state.

Furthermore, the lever 178, pressed by the carriage 23 moving farther rightwardly from the first position and then separated away from the carriage 23 moving leftwardly, is released from the locking by the third locking section. With this, the sliding member 171 and the lever 178 are moved leftwardly by the urging force of the spring 180. Then, the lever 178 is locked by the first locking section. As a result, the state of the switching mechanism 170 is changed from the third state depicted in FIG. 5C to the first state depicted in FIG. 5A. Namely, the lever 178 is contacted by and separated from the carriage 23 which is moving from the first position to the second position to thereby switch the state of the switching mechanism 170 from the third state into the first state.

Namely, the state of the switching mechanism 170 is switched by the contact and separation of the carriage 23 with respect to the lever 178. In other words, the transmittance destinations of the driving forces of the feeding motor 101 and the conveyance motor 102 are switched by the carriage 23. Note that the state of the switching mechanism 170 according to the present embodiment is not switched directly from the third state to the second state; rather, the state of the switching mechanism 170 is required to be switched from the third state to the first state, then further switched from the first state to the second state, as described above.

<Electric Power Source 110>

The multi-function peripheral 10 has the electric power source 110, as depicted in FIG. 6. The electric power source 110 supplies the electric power, supplied thereto from an external power source via a power plug, to the respective constituent components, parts, etc., of the multi-function peripheral 10. More specifically, the electric power source 110 outputs the electric power obtained from the external power source as a driving electric power (for example, electric power in a range of 24V to 26V) to the respective motors 101 to 103 and the recording head 39, and outputs the electric power as a controlling electric power (for example, 5V) to the controller 130.

Further, the electric power source 110 is capable of being switched (switchable) between a driving state and a sleeping state, based on a power signal outputted from the controller 130. More specifically, the controller 130 outputs a HIGH level power signal (for example, 5V) to thereby switch the electric power source 110 from the sleeping state to the driving state. On the other hand, the controller 130 outputs a LOW level power signal (for example, 0 (zero) V) to thereby switch the electric power source 110 from the driving state to the sleeping state.

The term "driving state" means a state in which the driving electric power is output to the motors 101 to 103 and to the recording head 39. In other words, the driving state means a state in which the motors 101 to 103 and the recording head 39 are each in an operable (active) state. The term "sleeping state" means a state in which the driving electric power is not output to the motors 101 to 103 and to the recording head 39. In other words, the sleeping state means a state in which the motors 101 to 103 and the recording head 39 are each in an inoperative (inactive) state. Although any illustration in the drawings is omitted, the electric power source 110 outputs the controlling electric power to the controller 130 and a communicating section 50 (see FIG. 6), regardless of whether or not the electric power source 110 is in the driving state or in the sleeping state.

<Controller 130>

As depicted in FIG. 6, the controller 130 is provided with a CPU 131, a ROM 132, a RAM 133, an EEPROM 134 and an ASIC 135 which are connected to one another by an internal bus 137. The ROM 132 stores various programs which are executed by the CPU 131 to thereby control a variety of kinds of operations. The RAM 133 is used as a storage area for temporarily storing a data and/or signal to be used when the CPU 131 executes the program(s), or as a working area for data processing. The EEPROM 134 stores setting information which should be stored even after the power source of the multi-function peripheral 10 is switched off.

In this embodiment, the EEPROM 134 stores time information indicating a time at which a first FLS processing (to be described later on) has been executed immediately before or most recently (hereinafter referred to as "FLS execution time"). The controller 130 obtains the time information from a system clock (not depicted in the drawings) at a timing at which the first FLS processing is executed, and causes the EEPROM 134 to store the obtained time information. Further, under a condition that the time information has been already stored in the EEPROM 134, the controller 130 overwrites the time information, which has been already stored, with new time information.

The feeding motor 101, the conveyance motor 102 and the carriage motor 103 are connected to the ASIC 135. The ASIC 135 generates a driving signal for rotating each of the motors, and outputs the generated driving signal to each of the motors. Each of the motors is driven to rotate in the normal direction or in the reverse direction, in accordance with the driving signal from the ASIC 135. Further, the controller 130 applies the driving voltage of the electric power source 110 to the vibrating elements of the recording head 39 to thereby cause the ink droplets to be jetted or discharged from the nozzles 40.

Further, the communicating section 50 is connected to the ASIC 135. The communicating section 50 is a communicating interface capable of communicating with an information processing apparatus 51. The information processing apparatus 51 may be, for example, a smart phone, a tablet PC or a personal computer. Namely, the controller 130 outputs a variety kinds of information to the information processing apparatus 51 via the communicating section 50, and receives or accepts a variety of kinds of information from the information processing apparatus 51 via the communicating section 50. The communicating section 50 may be, for example, a communicating interface such as a Wi-Fi module which is configured to transmit and receive a radio signal by a communication protocol in accordance with Wi-Fi (trade name by Wi-Fi Alliance). Alternatively, the communicating section 50 may be, for example, a communicating interface to which a LAN cable, a USB cable, an IEEE 1394 cable or a Thunderbolt (trade name by Intel Corporation) cable is connected. Note that the communicating section 50 may be a communicating interface of wired type or a communicating interface of wireless type. Note that in FIG. 6, the information processing apparatus 51 is surrounded by a frame drawn with a broken line so as to distinguish the information processing apparatus 51 from the constituents of the multi-function peripheral 10.

Further, the registration sensor 120, the rotary encoder 121, the carriage sensor 38, the media sensor 122 and the cap sensor 123 are connected to the ASIC 135. The controller 130 detects the position of the sheet 12 based on the detection signal outputted from the registration sensor 120 and the pulse signal outputted from the rotary encoder 121. Further, the controller 130 detects the position of the carriage 23 based on the pulse signal outputted from the carriage sensor 38. Furthermore, the controller 130 detects the position of the cap 71 based on the detection signal outputted from the cap sensor 123.

Moreover, the controller 130 detects the sheet 12 conveyed by the conveyer based on the detection signal outputted from the media sensor 122. More specifically, the controller 130 compares an amount of change (change amount) in signal level between signals, which are temporarily adjacent, with a predetermined threshold value. Further, under a condition that the change amount in the signal level becomes to be not less than the threshold value, the controller 130 detects that the forward (tip) end portion of the sheet 12 has reached a position at which the forward end faces the media sensor 122 in the up-down direction 7.

Furthermore, an automatic FLS flag is stored in the RAM 133 or the EEPROM 134. The automatic FLS flag is information indicating whether or not a second FLS processing (to be described later on) is to be executed, regardless of an elapsed time T elapsed since the first FLS processing (to be described later on) has completed. A first value "ON" corresponding to the execution of the second FLS processing regardless of the elapsed time T, or a second value "OFF" corresponding to execution of a determination of whether or not the second FLS processing is necessary based on the elapsed time T, is set in the automatic FLS flag.

<Image Recording Processing>

Next, an explanation will be given about an image recording processing of the present embodiment, with reference to FIGS. 7 to 10. Note that at a time of starting the image recording processing, it is provided (assumed) that the carriage 23 is located at the first position, the cap 71 is located at the covering position, and the switching mechanism 170 is in the third state. The respective processing to be described below may be executed such that the CPU 131 reads out the program stored in the ROM 132 and executes the read program, or may be executed by a hardware circuit mounted on the controller 130. Note that the order of execution of the respective processings may be appropriately changed, without departing from the gist and/or scope of the present teaching.

Firstly, although any illustration is omitted in the drawings, under a condition that the information processing apparatus 51 receives, from a user, a command for causing the multi-peripheral 10 to execute the image recording processing, the information processing apparatus 51 transmits a preceding command to the multi-function peripheral 10. The preceding command is a command previously announcing transmittance of a recording command (to be described later on). Next, under a condition that the information processing apparatus 51 has transmitted the preceding command, the information processing apparatus 51 converts an image data which is designated by the user to a raster data (the information processing apparatus 51 generates a raster data from an image data designated by the user). Then, under a condition that the information processing apparatus 51 has generated the raster data, the information processing apparatus 51 transmits the recording command to the multi-function peripheral 10. The recording command is a command causing an image indicated by the raster data to be recorded on a sheet.

The preceding command may include mode information indicating a recording mode. The term "recording mode" indicates an image quality of an image which is to be recorded in the image recording processing. The recording mode is designated, for example, by a user instructing the image recording processing via the information processing apparatus 51. In the mode information, for example, a third value "draft", or a fourth value "fine" corresponding to an image quality higher than the third value "draft", is set as a set value indicating the recording mode. Further, a generation time required for the image processing apparatus 51 to generate a recording command (in other words, a raster data) may vary depending on the recording mode. More specifically, a generation time in a case that the third value "draft" is set in the mode information tends to be shorter than that in a case that the fourth value "fine" is set in the mode information.

As described above, the mode information is an example of generation time information indicating the length of the time required for the information processing apparatus 51 to generate the recording command. Note that, however, the specific example of the generation time information is not limited to or restricted by the mode information, and the generation time information may be, for example, size information indicating data size of an image data as an object for the image recording processing, etc. Namely, the generation time tends to be longer as the data size is greater, and tends to be shorter as the data size is smaller.

The recording command may include ink droplet information indicating a size of an ink droplet of the ink which is to be jetted by the recording head 39 (more specifically, an ink amount of one ink droplet). For example, a fifth value "small droplet", or a sixth value "large droplet" corresponding to an ink droplet greater than the fifth value "small droplet", is set in the ink droplet information. The size of the ink droplet may be common to all the ink droplets jetted onto a sheet, or may be different among the respective ink droplets. Further, the image quality of an image recorded with the small ink droplets tends to be higher than the image quality of an image recorded with the large ink droplets. Namely, the ink droplet information is an example of image quality information indicating the quality of an image to be recorded in the recording processing. Further, the recording command may include the above-described mode information. Namely, the mode information is another example of the image quality information.

Firstly, under a condition that the controller 130 has received the preceding command from the information processing apparatus 51 via the communicating section 50 (S11: YES), the controller 130 executes a shot count determining processing (S12). The shot count determining processing is a processing for determining a FLS shot count in the first FLS processing. The FLS shot count is the number of ink droplets which are (to be) jetted from each of the respective nozzles 40 in the flushing processing. The shot count determining processing will be explained in detail with reference to FIG. 8A.

<Shot Count Determining Processing>

At first, the controller 130 determines the set value in the mode information included in the preceding command received in step S11 (S31). As described above, the length of the time required for the information processing apparatus 51 to generate the recording command may vary depending on the recording mode. In other words, the length of the time since the receipt of the preceding command until the receipt of the recording command may vary depending on the recording mode. In view of this, the controller 130 is capable of estimating (presuming) the elapsed time T since the completion of the first FLS processing until the receipt of the recording command, based on the set value in the mode information. The processing in step S31 is an example of a first estimating processing.

Under a condition that the third value "draft" is set in the mode information (S31: Draft), the controller 130 estimates that the elapsed time T, elapsed since the completion of the first FLS processing and until the receipt of the recording command would be less than a first threshold time $T_{th1}$ (to be described later on). Then, the controller 130 determines the FLS shot count to be α shots (S32), sets the second value "OFF" in the automatic FLS flag (S33), and completes the shot count determining processing.

On the other hand, under a condition that the fourth value "fine" is set in the mode information (S31: Fine), the controller 130 estimates that the elapsed time T, elapsed since the completion of the first FLS processing and until the receipt of the recording command would be not less than the first threshold time $T_{th1}$. Then, the controller 130 determines the FLS shot count to be β shots (S34), sets the first value "ON" in the automatic FLS flag (S35), and completes the shot count determining processing.

Note that α shots determined as the FLS shot count (FLS shot count=α shots) is an example of the first ink amount necessary for executing the recording processing. More specifically, FLS shot count=α shots is an ink amount required for maintaining a predetermined image recording quality in a recording processing which is executed until the first threshold time $T_{th1}$ has elapsed since the completion of the first FLS processing. Namely, under a condition that the controller 130 has caused a shots of the ink droplets to be jetted from each of the nozzles 40 in the first FLS processing and that the controller 130 receives the recording command until the first threshold time $T_{th1}$ elapses since the completion of the first FLS processing, the controller 130 is capable of perform recording of an image with a predetermined image recording quality by executing the recording processing even without the execution of the second FLS processing.

On the other hand, FLS shot count=β shots is an example of a second ink amount smaller than the α shots. More specifically, FLS shot count=β shots is such an ink amount that cannot maintain the predetermined image recording quality in the recording processing. Namely, in a case that the controller 130 causes β shots of the ink droplets to be jetted from each of the nozzles 40 in the first FLS processing, the controller 130 cannot maintain the predetermined image recording quality unless the controller 130 executes the recording processing after executing the second FLS processing.

Further, the first threshold time $T_{th1}$ is a value determined in a threshold determining processing (to be described later on), and is an indefinite value (for example, a value in a range of 1 second to 3 seconds) at a point of time at which the shot count determining processing is executed. In view of this, the controller 130 may estimate, for example in step S31, whether or not the elapsed time T is not less than the maximum value (3 seconds in this embodiment) of the first threshold time $T_{th1}$.

Figure 9:
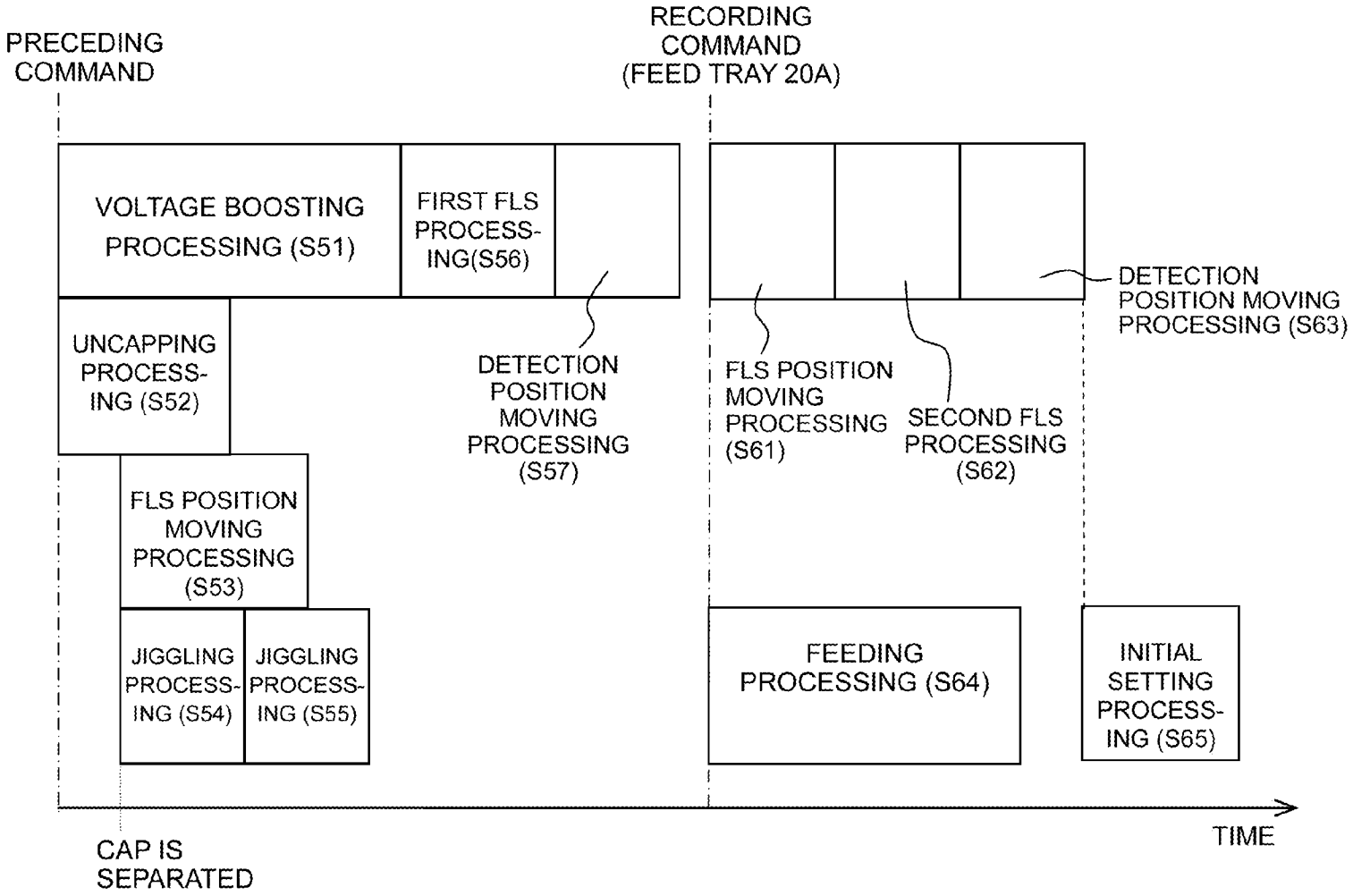
FIG. 9 is a timing chart depicting execution timings for a first preparing processing and a second preparing processing.

Next, returning to FIG. 7, the controller 130 executes a first preparing processing (S13). Namely, the preceding command can be rephrased as a command for instructing the execution of the first preparing processing. The first preparing processing is a processing for allowing the printer 11 to be in a state that the recording processing can be executed. The phrase that "the state that the recording processing can be executed" can be rephrased as, for example, a state that an image can be recorded with a quality of not less than a predetermined level. The first preparing processing includes, for example, a voltage boosting processing (S51), a uncapping processing (S52), a FLS position moving processing (S53), a jiggling processing (S54, S55), the first FLS processing (S56), and a detection position moving processing (S57) as depicted in FIG. 9.

The voltage boosting processing (S51) is a processing for boosting (raising) the driving voltage, which is to be supplied by the electric power source 110 to the respective elements of the printer 11, up to a predetermined FLS voltage $V_F$. The electric power source 110 boosts, for example, the power source voltage, supplied from the external power source, up to the FLS voltage $V_F$ with a non-illustrated regulator circuit. Boosting the voltage of the electric power source 110 means, for example, storing the charge in a power storage element such as a non-illustrated condenser, etc. Further, in a case that the charge corresponding to the FLS voltage $V_F$ has been stored in the power storage element, then the regulator circuit continuously applies the voltage for maintaining the driving voltage to the power storage element. The FLS voltage $V_F$ may be, for example, 24V which is same as that in a case of jetting the ink in the recording processing.

Note that, however, if the driving voltage is boosted rapidly, there is such a possibility that the driving voltage during the voltage boosting might be unstable. In view of this possibility, for example, the controller 130 boosts the driving voltage up to a check voltage $V_1$ with a feedback control. Next, under a condition that the driving voltage has reached the check voltage $V_1$, the controller 130 raises the driving voltage up to a check voltage $V_2$ with the feedback control. In such a manner, the driving voltage is boosted by repeating a plurality of voltage boosting steps. Namely, $V_1<V_2<\ldots<V_F$ holds. With this, the variation or fluctuation of the driving voltage during the voltage boosting can be suppressed. Note that the check voltages $V_1$, $V_2$, . . . are set more finely as approaching the FLS voltage $V_F$. In a case wherein the FLS voltage $V_F$ is 24V, the check voltages are set, for example, to be 20V, 22V, 23V, 23.5V, 23.75V, respectively.

Further, in a state that the controller 130 allows the electric power source 110 to apply the driving voltage to the recording head 39, the controller 130 may execute the voltage boosting processing. The phrase of the "state that (the controller 130 allows the electric power source 110) to apply the driving voltage to the recording head 39" means, for example, a state that the driving voltage which is being boosted is applied to the vibrating elements of the recording head 39 by allowing a switch element of a circuit from the electric power source 110 up to the recording head 39 to have a conducted state. In other words, the above state also can be expressed as such a state that in a case that the driving voltage which is being boosted reaches 24V, the ink droplets can be jetted from the nozzles 40. With this, for the reason stated below, the variation in the driving voltage which is being boosted can be suppressed further.

At first, generally, in a case that the voltage applied to a circuit is varied, the raising time and the falling time of the voltage waveform becomes longer as a resistance component inside the circuit is greater. Namely, as the resistance component is greater, the change in the voltage per unit time is smaller. Further, a transistor constructing the switch element, an output section configured to output the driving signal, etc., are present in the circuit from the electric power source 110 up to the vibrating elements of the recording head 39. Accordingly, if provided that the electric power source 110 up to the recording head 39 are considered as one circuit, it is possible to attenuate the variation in the driving voltage during the voltage boosting, as compared with a case of shutting off the connection between the electric power source 110 and the recording head 39 to thereby provide the circuit solely for the electric power source 110 alone.

Further, a control circuit of the recording head 39 having the vibrating elements can be considered as a condenser having a predetermined capacitance. Further, this condenser repeats the charging and discharging accompanying with the variation in the driving voltage applied thereto. As a result, it is possible to remove a high frequency component included in the variation in the voltage, thereby making it possible to further attenuate the variation in the driving voltage during the voltage boosting.

Furthermore, the voltage boosting processing (S51) is executed typically at a timing at which the power is turned ON in the multi-function peripheral 10, or a timing at which the electric power source 110 is switched from the sleeping state to the driving state. Namely, in a case that the driving voltage supplied from the electric power source 110 has already reached the FLS voltage $V_F$, the voltage boosting processing (S51) is omitted, in some cases.

The uncapping processing (S52) is a processing for moving the cap 71 from the covering position to the separate position. Namely, the controller 130 rotates the feeding motor 101 just by a predetermined rotational amount. Then, by allowing the rotary driving force of the feeding motor 101 to be transmitted to the ascending/descending mechanism 71A for the cap 71) via the switching mechanism 170 in the third state, the cap 71 is moved from the covering position to the separate position. Further, the detection signal outputted from the cap sensor 123 is changed from the HIGH level signal to the LOW level signal before the cap 71 reaches the separate position, in other words, during the execution of the uncapping processing.

Figure 10A:
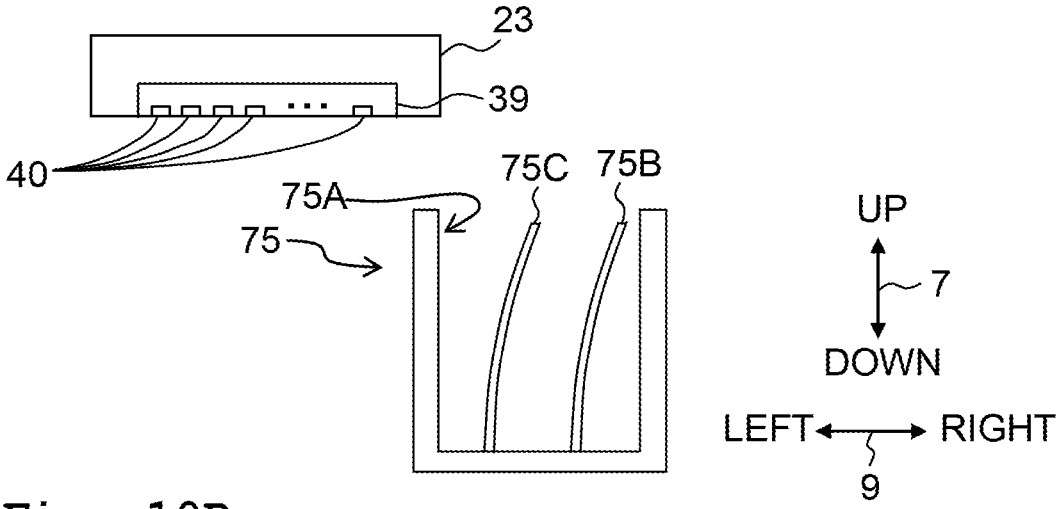
Figure 10B:
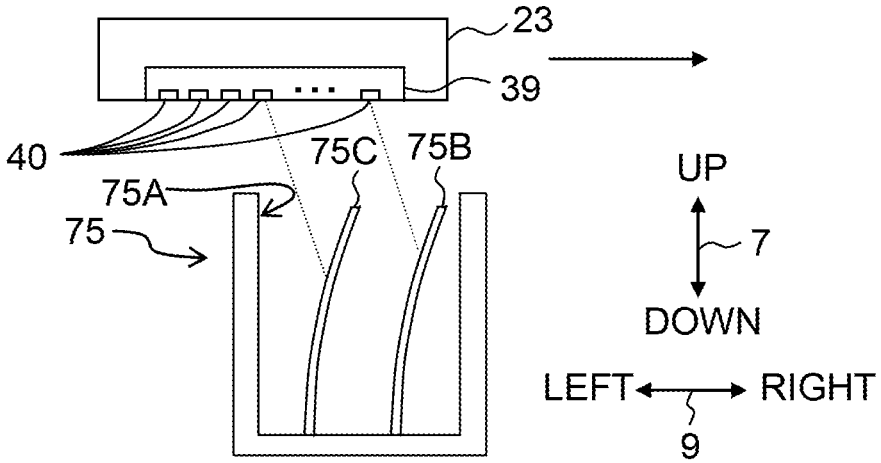
Figure 10C:
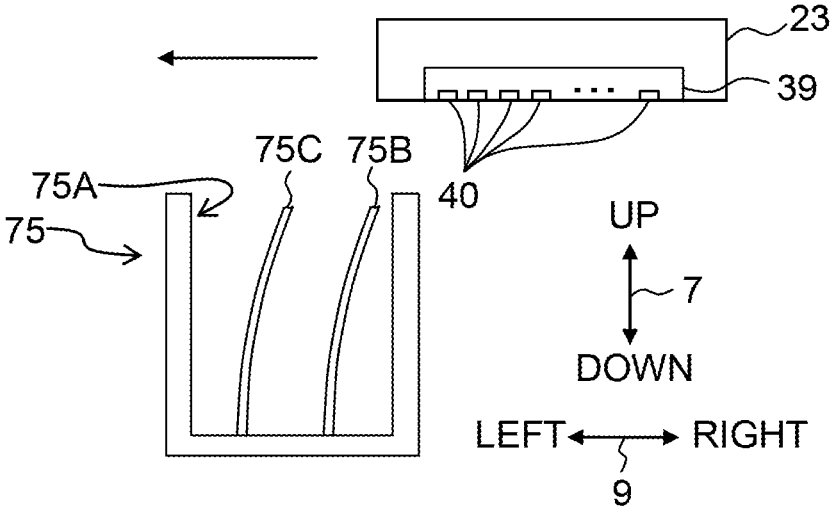

The FLS position moving processing (S53) includes a processing for switching the state of the switching mechanism 170 from the third state to the first state, and a processing for moving the carriage 23 from which the cap 71 has been separated away is moved from the first position toward the second position. Namely, the controller 130 causes the carriage 23 at the first position to move rightwardly, and then to move leftwardly toward the second position. In step S53, the controller 130 causes the carriage 23 to reach a position on the left side relative to the ink receiving section 75, as indicated in FIG. 10A. Further, in order to suppress any destruction of the meniscus of the ink formed in the nozzles 40 of the recording head 39, it is allowable that the controller 130 causes the carriage 23 to move leftwardly at a low speed or velocity at the time at which the processing of step S53 is started, and then the controller 130 executes the processing of step S53.

The jiggling processing (S54, S55) is a processing for causing at least one of the feeding motor 101 and the conveyance motor 102 to rotate a little (in a wiggling manner) alternately in the normal and reverse directions. More specifically, under the condition that the switching mechanism 170 is in the third state, the controller 130 causes both of the feeding motor 101 and the conveyance motor 102 to rotate in the wiggling manner alternately in the normal and reverse directions (S54). With this, since the bearing stress between the driving gear 172 and the gear 176 and the bearing stress between the driving gear 173 and the gear 177 are released, the meshings among the respective gears can be released smoothly. Further, in a case that the state of the switching mechanism 170 is changed into the first state, the controller 130 causes the feeding motor 101 to rotate in the wiggling manner alternately in the normal and reverse directions (S55). With this, the driving gear 172 and the gear 174 can be meshed with each other smoothly. Note that the jiggling processing may be only one of steps S54 and S55.

The first FLS processing (S56) is an example of the first flushing processing for causing the recording head 39 to jet the ink toward the ink receiving section 75. Namely, in a process, in step S56, in which the controller 130 causes the carriage 23 to move at a predetermined CR velocity, the controller 130 applies the FLS voltage $V_F$ to the vibrating elements, thereby causing the recording head 39 to jet the ink droplets of which number is the FLS shot count. More specifically, the controller 130 causes the carriage 23 to move rightwardly from a position depicted in FIG. 10A, and causes the ink droplets of which number is the FLS shot count to be jetted from each of the nozzles 40 at a predetermined timing for each of the nozzles 40. Note that in a period of time during which the first FLS processing is being executed, the carriage 23 is accelerated up to the CR velocity from a state that the carriage 23 is stopped; then the carriage 23 moves at a constant velocity that is the CR velocity. Namely, the CR velocity indicates the maximum velocity or a target velocity of the carriage 23 in the first FLS processing.

An ink droplet jetting timing at which the ink droplets are jetted is previously determined such that the ink droplets are each allowed to land on a target position on each of the guide plates 75B and 75C. The jetting timing for each of the nozzles 40 is specified, for example, based on a pulse signal outputted from the carriage sensor 38. In the present embodiment, for example as indicated in broken lines in FIG. 10B, ink droplets are jetted at an initial timing from nozzle rows on the right end and configured to jet the black ink and from nozzle rows which are adjacent to the nozzle rows, on the right end and configured to jet the black ink, and which are configured to jet the yellow ink; and then ink droplets are jetted at a next timing from two groups of nozzle rows located to be immediate left of the nozzle rows from which the ink droplets of the black ink and the yellow inks have been jetted at the first timing. Namely, the controller 130 causes the ink droplets from each of the nozzles 40 in the nozzle arrangement order in the main scanning direction (namely, in an order from right to left).

Note that before the controller 130 executes the first FLS processing, the controller 130 may further execute a non-jetting flushing processing. The term "non-jetting flushing processing" means a processing for vibrating the vibrating elements to such an extent that any ink droplets are not jetted from the nozzles 40. The non-jetting flushing processing may be executed at any timing after the completion of the voltage boosting processing. With this, the ink droplets are allowed to be easily jetted from the nozzles 40 in the flushing processing.

The detection position moving processing (S57) is an example of a first moving processing for moving the carriage 23 to a detection position. The term "detection position" means a position which is located at the sheet facing area and through which a sheet 12 of each of all the sizes (for example, A4, B4, L-size, etc.) supportable by the feed trays 20A and 20B passes. In a case that the sheet 12 is supported by the feed tray 20A or 20B in a state that the center in the main scanning direction of the sheet 12 is positioned with respect to the feed tray 20A or 20B, the detection position may be located at the center in the main scanning direction of the sheet facing section. Under a condition that the ink droplets of which number is the FLS shot count have been jetted from all the nozzle 40 in the first FLS processing, the controller 130 causes the carriage 23, which is being moved, to reach the detection position without stopping the carriage 23.

Note that as depicted in FIG. 9, the controller 130 starts the processing of step S51 and the processing of step S52 at the same time at a timing at which the controller 130 receives the preceding command. Namely, the controller 130 executes the processing of step S51 and the processing of step S52 in parallel. Further, the controller 130 starts the processing of step S53 and the processing of step S54 at the same time. Namely, the controller 130 executes the processing of step S53, the processing of step S54 and the processing of step S55 in parallel. Note that, however, the execution timings for the steps S51 to S55, respectively, are not limited to or restricted by the example depicted in FIG. 9.

Further, the controller 130 starts the processing of step S53 at a timing at which the detection signal from the cap sensor 123 is changed from the HIGH level signal to the LOW level signal. Namely, the controller 130 starts the processing of step S53 after starting the processings of steps S51 and S52. More specifically, the controller 130 executes the processing which is included in step S53 and which is for moving the carriage 23 leftwardly at a low velocity and the processing which is included in step S53 and which is for moving the carriage 23 rightwardly from the first position, in parallel with the processing of step S52. On the other hand, the controller 130 executes the processing which is included in the processing of step S53 and which is for moving the carriage 23 leftwardly up to the second position, after completing the processing of step S52.

Typically, the execution time (duration) of the voltage boosting processing (S51) is the longest among the plurality of processings included in the first preparing processing (S51 to S55). In view of this, the controller 130 executes the processing of step S51 in parallel with the respective processings of step S52 to S55. In other words, the controller 130 executes the processings of steps S52 to S55 at predetermined timings therefor, respectively, while executing the processing of step S51, as depicted in FIG. 9. Further in other words, the respective processings of steps S52 to 55 are executed in parallel with the processing of step S51. On the other hand, the controller 130 starts the processing of step S56 after completing the processing of step S51, and starts the processing of step S57 after completing the processing of step S56.

Next, returning to FIG. 7 again, until the controller 130 receives a recording command from the information processing apparatus 51 via the communicating section 50 (S14: NO), or until the elapsed time T elapsed after the completion of the first FLS processing reaches the second threshold time $T_{th2}$ (S21: NO), the controller 130 holds the execution of the processings thereafter. The elapsed time T is the difference between the FLS execution time stored in the EEPROM 134 and the current time. The second threshold time $T_{th2}$ is a time (duration) which is sufficiently longer than the first threshold time $T_{th1}$ (for example, 5 seconds).

Under a condition that the controller 130 has received a recording command from the information processing apparatus 51 via the communicating section 50 (S14: YES), the controller 130 makes determination regarding the set value set in the automatic FLS flag (S15). Then, under a condition that the second value "OFF" is set in the automatic FLS flag (S15: OFF), the controller 130 executes a threshold value determining processing (S17). The threshold determining processing is a processing for determining the value of the first threshold time $T_{th1}$. The threshold value determining processing will be explained in detail, with reference to FIG. 8.

At first, the controller 130 compares an ambient temperature of the recording head 39 with a predetermined threshold temperature (S41). The ambient temperature of the recording head 39 may be detected, for example, by a sensor mounted on the carriage 23, etc. Generally, the viscosity of the ink tends to be lower as the temperature becomes higher, and tends to be higher as the temperature becomes lower. In view of this, the controller 130 is capable of estimating the viscosity of the ink inside the recording head 39, based on the ambient temperature of the recording head 39. The processing in step S41 is an example of a second estimating processing.

Then, under a condition that the ambient temperature is not less than the threshold temperature (S41: YES), the controller 130 estimates that the viscosity of the ink is less than a predetermined threshold viscosity. Further, the controller 130 determines the first threshold time $T_{th1}$ to be a first time (for example, 3 seconds) (S42). On the other hand, under a condition that the ambient temperature is less than the threshold temperature (S41: NO), the controller 130 estimates that the viscosity of the ink is not less than the predetermined threshold viscosity. Further, the controller 130 determines the first threshold time $T_{th1}$ to be a second time (for example, 1 second) (S43). Note that the first time is longer than the second time.

Next, returning to FIG. 7 again, the controller 130 compares the elapsed time T elapsed since the completion of the first FLS processing with the first threshold time $T_{th1}$ determined in step S17 (S18). In other words, the controller 130 determines whether or not the second FLS processing is necessary in order to maintain the predetermined image recording quality in the recording processing which is to be executed based on the recording command received in step S14. The processing in step S18 is an example of a first determining processing.

Then, under a condition that the controller 130 determines that the elapsed time T is not less than the first threshold time $T_{th1}$ (S18: YES), the controller 130 executes a second preparing processing including the second FLS processing (S16). The second preparing processing is a processing which is included in the processing for allowing the printer 11 to be in the state that the recording processing can be executed, but which is not included in the first preparing processing. The second preparing processing includes, for example, a FLS position moving processing (S61), the second FLS processing (S62), a detection position moving processing (S63), a feeding processing (S64) and an initial setting processing (cue-feeding processing) (S65), as depicted in FIG. 9.

The FLS position moving processing (S61) is a processing for moving the carriage 23 from the detection position toward the second position. Namely, the controller 130 causes the carriage 23 to reach a position on the left side relative to the ink receiving section 75, as depicted in FIG. 10A. The detection position moving processing (S63) is similar to the processing of step S57.

The second FLS processing (S62) is an example of a second flushing processing for causing the recording head 39 to jet the ink droplets toward the ink receiving section 75. The specific processing content of the second FLS processing may be same as that of the first FLS processing. Note that, however, the first FLS processing and the second FLS processing are different from each other, for example, in the FLS shot count thereof. For example, it is preferred that the FLS shot count of the second FLS processing is smaller than that of the first FLS processing. Further, the FLS shot count of the second FLS processing is preferably greater (larger) as the elapsed time T becomes longer.

The feeding processing (S64) is a processing for causing the feeding section 15A to feed a sheet 12, supported by the feed tray 20A, up to a position at which the sheet 12 reaches the conveyance roller section 54. This feeding processing is executed in a case that the recording command indicates the feed tray 20A as the feeding source from where the sheet 12 is fed. The controller 130 causes the feeding motor 101 to rotate normally, and causes the feeding motor 101 to further rotate normally by a predetermined rotation amount after the detection signal of the registration sensor 120 is changed from the LOW level signal to the HIGH level signal. Further, in a case that the rotary driving force of the feeding motor 101 is transmitted to the feeding roller 25A via the switching mechanism 170 in the first state, the sheet 12 supported by the feed tray 20A is thereby fed to the conveyance route 65.

The initial setting processing (cue-feeding processing) (S65) is a processing for causing the conveyer to convey, in the conveyance direction 16, the sheet 12, which has been conveyed by the feeding processing and has reached the conveyance roller section 54, up to a facing position at which an area, of the sheet 12, in which an image is to be recorded first (hereinafter referred also to as a "recording area" or "initial recording area" in some cases) may face the recording head 39. The initial recording area on the sheet 12 is indicated in the recording command. The controller 130 causes the conveyance motor 102 to rotate normally to thereby cause the media sensor 122 to detect the forward end of the sheet 12, and to further cause the conveyer to convey the sheet 12, which has reached the conveyance roller section 54, until the initial recording area indicated by the recording command faces the recording head 39.

Note that the respective processings (S61 to S65) which are included in the second preparing processing cannot be started unless at least a portion of the plurality of processings included in the first preparing processing has been already completed. The FLS position moving processing (S61) cannot be started unless the detection position moving processing (S57) has been already completed, but can be started even if the jiggling processing (S55) has not been completed yet. On the other hand, the feeding processing (S64) cannot be started unless the jiggling processing (S55) has been already completed, but can be started even if the detection position moving processing (S57) has not been completed yet.

Further, the second FLS processing (S62) cannot be started unless the FLS position moving processing (S61) has been already completed. Further, the detection position moving processing (S63) cannot be started unless the second FLS processing (S62) has been already completed. Further, the initial setting processing (S65) cannot be started unless the feeding processing (S64) and the detection position moving processing (S63) have been already completed. Namely, the controller 130 executes the second FLS processing (S62) and the feeding processing (S64) in parallel.

Further, although any illustration is omitted in the drawings, in a case that the recording command indicates the feed tray 20B as the feeding source from where the sheet 12 is fed, the controller 130 switches the state of the switching mechanism 170 from the first state to the second state prior to executing the FLS position moving processing (S61). Namely, the controller 130 causes the carriage 23 which is located at the detection position to move rightwardly, and causes the lever 178 which has been locked by the first locking section to be locked by the second locking section. Then, under a condition that the switching mechanism 170 has been switched into the second state, the controller 130 causes the carriage 23 to move to the second position. Then, under the condition that the switching mechanism 170 has been switched into the second state, the controller 130 starts the feeding processing for feeding the sheet 12 supported by the feed tray 20B.

Returning to FIG. 7 again, under a condition that all the processings included in the second preparing processing have been completed, the controller 130 executes the recording processing in accordance with the received recording command (S20). The recording processing includes, for example, a jetting processing and a conveying processing which are executed alternately, and a discharging processing. The jetting processing is a processing for causing the recording head 39 to jet ink droplets with respect to the recording area of the sheet 12 which is made to face the recording head 39. The conveying processing is a processing for causing the conveyer to convey the sheet 12 only by an amount corresponding to a predetermined conveyance width along the conveyance direction 16. The discharging processing is a processing for causing the discharge roller section 55 to discharge the sheet 12, having an image recorded thereon, to the discharge tray 21.

Namely, the controller 130 executes the jetting processing for moving the carriage 23 from one end to the other end of the sheet facing area, and for causing the recording head 39 to jet ink droplets at a timing indicated by the recording command. Next, under a condition that there is an image to be recorded on a next recording area, the controller 130 executes the conveying processing for causing the conveyer to convey the sheet 12 up to a position at which the next recording area faces the recording head 39. Until the controller 130 records image(s) to all the recording areas, the controller 130 executes the jetting processing and the conveying processing repeatedly. Under a condition that the image(s) have been recorded on all the recording areas, the controller 130 executes the discharging processing for causing the discharge roller section 55 to discharge the sheet 12 to the discharge tray 21.

Further, under a condition that the first value "ON" is set in the automatic FLS flag (S15: ON), the controller 130 executes the second preparing processing (S16) and the recording processing (S20), without executing the processing of step S17 and the processing of step S18. Namely, under the condition that the controller 130 determines that the first value "ON" is set in the automatic FLS flag (S15: ON), the controller 130 executes the second FLS processing (S62) and then executes the recording processing (S20), regardless of the length of the elapsed time T.

On the other hand, under a condition that the controller 130 determines that the elapsed time T is less than the first threshold time $T_{th1}$ (S18: NO), the controller 130 executes the second preparing processing (S19) which does not include the second FLS processing (S62). More specifically, the second preparing processing executed in step S19 is different from the processing of step S16 in view of not including the FLS position moving processing (S61), the second FLS processing (S62) and the detection position moving processing (S63), but is common to the processing in step S16 other than the non-inclusion of the FLS position moving processing (S61), the second FLS processing (S62) and the detection position moving processing (S63). Namely, under the condition that the controller 130 determines that the elapsed time T is less than the first threshold time $T_{th1}$ (S18: NO), the controller 130 executes the recording processing (S20), without executing the second FLS processing (S62).

Further, under a condition that the controller 130 does not receive the recording command, (via the communicating section 50,) before the elapsed time T reaches the second threshold time $T_{th2}$ (S14: NO & S21: YES), the controller 130 executes a stand-by processing (S22). The stand-by processing is a processing for waiting until the recording command is received, in a state that the recording head 39 is covered by the cap 71. Namely, the controller 130 causes the carriage 23 to move toward the first position, to thereby change the switching mechanism 170 into the third state.

This processing is an example of a second moving processing. Further, under a condition that the carriage 23 has reached the first position, the controller 130 causes the cap 71 to move to the covering position. This processing is an example of a capping processing.

Then, the controller 130 stands by until the controller 130 receives the recording command, (via the communicating section 50,) from the information processing apparatus (S23: NO). Further, under a condition that a predetermined time has elapsed since the cap 71 has been moved to the covering position, the controller 130 switches the electric power source 110 from the driving state to the sleeping state, and executes a so-called discharge flushing. The discharge flushing is a processing for causing the regulator circuit to stop the voltage application with respect to the power storage element, and for applying the driving voltage to the vibrating element to thereby vibrate the vibrating element. With this, the charge stored in the power storage element is instantaneously released. Further, even if an ink droplet is jetted from the nozzle 40 due to the vibration of the vibrating element, the ink (ink droplet) lands inside the cap 71. Accordingly, it is possible to suppress any contamination of the sheet facing area.

Next, under a condition that the controller 130 receives a recording command from the information processing apparatus 51 via the communicating section 50 (S23: YES), the controller 130 executes the first preparing processing (S24), the second preparing processing (S19) which does not include the second FLS processing (S62), etc., and the recording processing (S20). Since the processing in step S24 is same as that in step S13, any explanation for step S24 will be omitted. Namely, under a condition that the controller 130 receives the recording command in a state that the carriage 23 is located at the first position and that the cap 71 is located at the covering position, the controller 130 executes only the first FLS processing among the first and second FLS processings, and then the controller 130 executes the recording processing. Note that first FLS processing executed at this time, the ink droplets of which FLS shot count is $\alpha$ shots (FLS shot count=$\alpha$ shots) are jetted.

According to the present embodiment, in a case that the elapsed time T elapsed since the completion of the first FLS processing (S56) has been ended and until the receipt of the recording command is long, the recording processing (S20) is executed after the execution of the second FLS processing (S62). Accordingly, it is possible to secure the image recording quality. Also in this case, the FPOT is already long at a point of time when the recording command is received, and thus the effect caused by the increase in the FPOT by the second FLS processing is relatively small. On the other hand, in a case that the elapsed time T is short, the recording processing is executed while skipping (omitting) the second FLS processing, thereby making is possible to shorten the FPOT. Further, in this case, the time from the completion of the first FLS processing and until the start of the recording processing is short, and thus it is also possible to suppress any lowering in the image recording quality.

Furthermore, according to the above-described embodiment, in a case that there is a high possibility that the elapsed time T is less than the first threshold time $T_{th1}$, the ink is jetted, in the first FLS processing, in the ink amount which is required for executing the recording processing. Accordingly, since there is no need to execute the second FLS processing, it is possible to shorten the FPOT while suppressing any lowering in the image recording quality. On the other hand, in a case that there is a high possibility that the elapsed time T is not less than the first threshold time $T_{th1}$, the ink amount required for executing the recording processing is jetted in a divided manner in the first FLS processing and the second FLS processing, thereby suppressing any wasteful consumption of the ink which would have been caused if the flushing processing were executed twice.

Further, according to the above-described embodiment, the extent as to how the second FLS processing is easily or actively executed is switched by increasing or decreasing the threshold time $T_{th1}$, depending on the estimated viscosity of the ink. Generally, in a case that the viscosity of the ink is high, there is such a tendency that the image recording quality is lowered greatly. In view of this, in a case that the viscosity of the ink is high, the second FLS processing is made to be actively executed, thereby making it possible to suppress any lowering in the image recording quality. On the other hand, in a case that the viscosity of the ink is low, the second FLS processing is made to be executed less actively, thereby making it possible to suppress the increase in the FPOT.

Note that, however, the estimating method for estimating the viscosity of the ink is not limited to or restricted by the ambient temperature of the recording head 39; it is allowable to estimate the viscosity of the ink based on, for example, the ambient temperature of the recording head 39, an elapsed time elapsed since the ink cartridge is installed in the installment section, or the combination of the former and the latter. The ambient temperature of the recording head 39, and the elapsed time elapsed since the ink cartridge is installed in the installment section can be detected by a non-illustrated sensor.

Namely, the controller 130 may estimate that the viscosity of the ink is less than the threshold viscosity, under a condition that the ambient temperature of the recording head 39 is not less than the threshold temperature. On the other hand, the controller 130 may estimate that the viscosity of the ink is not less than the threshold viscosity, under a condition that the ambient temperature of the recording head 39 is less than the threshold temperature. Further, the controller 130 may estimate that the viscosity of the ink is less than the threshold viscosity, under a condition that elapsed time elapsed since the ink cartridge is installed in the installment section is less than a threshold time. On the other hand, the controller 130 may estimate that the viscosity of the ink is not less than the threshold viscosity, under a condition that elapsed time elapsed since the ink cartridge is installed in the installment section is not less than the threshold time.

Furthermore, the extent as to how the second FLS processing is actively executed (namely, the first threshold time $T_{th1}$) may be switched depending not only on the viscosity of the ink, but also on the quality of an image to be recorded in the recording processing. As an example, controller 130 may set the first threshold time $T_{th1}$ in a case that the third value "draft" is set in the mode information included in the recording command to be longer than the first threshold time $T_{th1}$ in another case that the fourth value "fine" is set in the mode information. As another example, controller 130 may set the first threshold time $T_{th1}$ in a case that the sixth value "large droplet" is set in the ink droplet information included in the recording command to be longer than the first threshold time $T_{th1}$ in another case that the fifth value "small droplet" is set in the ink droplet information. Further, in a case that the ink droplet information is set for every ink droplet, the first threshold time $T_{th1}$ may be determined based on the ink droplet information corresponding to an ink droplet to be jetted in the initial jetting processing (a so-called first pass).

As described above, in a case that a high image recording quality (the mode information "fine", the ink droplet information "small droplet") is demanded, it is preferred that the second FLS processing is executed more actively, even if the FPOT is increased. On the other hand, in a case that any high image recording quality is not demanded (the mode information "draft", the ink droplet information "large droplet"), it is preferred that the second FLS processing is executed less actively, thereby suppressing the lowering in the FPOT.

Further, according to the embodiment, the FLS shot count of the second FLS processing is made to be smaller than the FLS shot count of the first FLS processing, thereby making it possible to further shorten the FPOT. Furthermore, since the FLS shot count of the second FLS processing is increased or decreased depending on the elapsed time T, it is possible to realize both of the shortening of the FPOT and the maintaining the image recording quality.

Moreover, according to the embodiment, in a case that the recording command cannot be received for a long period of time (namely, $T \geq T_{th2}$), the recording head 39 is covered by the cap 71 so as to make it possible to suppress any drying of the ink inside the recording head 39. With this, it is possible to suppress the ink amount to be jetted in the flushing processing. Also in this case, the FPOT is already long at a point of time when the recording command is received, and thus the effect caused by the increase in the FPOT by executing the first preparing processing over again is relatively small.

Further, in the flushing processing (S56, S62) according to the embodiment, an explanation has been given about an example wherein the recording head 39 is made to jet the ink droplets during a process in which the carriage 23 is being moved in the main scanning direction. However, it is also allowable that the recording head 39 is made to jet the ink droplets in a state that the carriage 23 is stopped at a position at which the carriage 23 faces the ink receiving section 75. Furthermore, in the embodiment, the explanation has been given about the example wherein the recording head 39 is made to jet the ink droplets during a process in which the carriage 23 is being moved in the main scanning direction. Note that, however, the recording head of the present teaching is not limited to or restricted by this example; the recording head of the present teaching may also be a so-called line head in which the nozzles are arranged (aligned) across the entirety of the sheet facing area.

Further, in step S18, the specific method for determining whether or not the elapsed time T has reached the threshold time $T_{th1}$ is not limited to the above-described example. As another example, the controller 130 starts a first timer configured to detect whether or not the elapsed time T has reached the first threshold time $T_{th1}$, under a condition that the first FLS processing has been completed. Furthermore, the RAM 133 stores a time flag. A seventh value "ON" indicating that the first timer is timed out or an eighth value "OFF" indicating that the first timer does not time out is set in the timer flag. The initial value of the timer flag is the eighth value "OFF".

Next, under a condition that the first timer has timed out, the controller 130 sets the seventh value "ON" in the first flag. On the other hand, under a condition that the controller 130 has received the recording command before the first timer times out, the controller 130 cancels the first timer. Further, under a condition that the controller 130 has receives the recording command (S14: YES), the controller 130 makes determination regarding the set value set in the timer flag (S18).

More specifically, under a condition that the seventh value "ON" is set in the timer flag (S18: YES), the controller 130 executes the processing in step S16. On the other hand, under a condition that the eighth value "OFF" is set in the timer flag (S18: NO), the controller 130 executes the processing in step S19. Namely, the processing for making determination regarding the set value set in the timer flag is another example of the first determining processing.

Similarly, under a condition that the first FLS processing has completed, the controller 130 may start a second timer configured to detect whether or not the elapsed time T has reached the second threshold time $T_{th2}$. Further, under a condition that the second timer times out before the controller 130 receives the recording command (S14: NO & S21: YES), the controller 130 may execute the processing of step S22. On the other hand, under a condition that the controller 130 has received the recording command before the second timer times out, the controller 130 may cancel the second timer.

Further, the starting timing of the first timer and the second timer is not limited to or restricted by the timing at which the first FLS processing is completed. Namely, in a case that there is only a variation (fluctuation) in the execution times, among the respective processings included in the first FLS processing (S13), to such an extent that the execution times can be evaluated to be always constant, it is allowable to start the timer at any timing before the first FLS processing is completed. This is similarly applicable also to the timing for obtaining the FLS execution time. As an example, the controller 130 may start the timer at a timing at which the controller 130 starts the first FLS processing. The first threshold time $T_{th1}$ in this case may be, for example, a value obtained by adding an anticipated time, previously determined and anticipated to be required for the first FLS processing (S56), to the time determined in the threshold value determining processing.

As another example, the controller 130 may start the timer at a timing at which the cap 71 is separated from the recording head 39. The first threshold time $T_{th1}$ in this case also may be, for example, a value obtained by adding an anticipated time, previously determined and anticipated to be required for the uncapping processing (S52), the FLS position moving processing (S53) and the first FLS processing (S56), to the time determined in the threshold value determining processing. As still another example, the controller 130 may start the timer at a timing at which the controller 130 receives the preceding command. The first threshold time $T_{th1}$ in this case also may be, for example, a value obtained by adding an anticipated time, previously determined and anticipated to be required for the shot count determining processing (S12) and the first preparing processing (S13), to the time determined in the threshold value determining processing.

What is claimed is:

1. An ink-jet printer configured to jet ink droplets toward a sheet, comprising:

a conveyer configured to convey the sheet in a conveyance direction;

a recording head having a plurality of nozzles and configured to jet the ink droplets from the plurality of nozzles toward the sheet conveyed by the conveyer;

an ink receiver;

a communicating interface; and a controller, wherein under a condition that the controller receives, from an information processing apparatus via the communicating interface, a preceding command notifying transmittance of a recording command which is an instruction for recording an image on the sheet, the controller is configured to control the recording head to execute a first flushing processing in which the recording head jets the ink droplets from the plurality of nozzles toward the ink receiver; and under a condition that an elapsed time, elapsed after completion of the first flushing processing is not less than a threshold time, and that the controller receives the recording command from the information processing apparatus via the communicating interface, the controller is configured to control the recording head to execute:

a second flushing processing in which the recording head jets the ink droplets from the plurality of nozzles toward the ink receiver, and a recording processing in which the recording head jets the ink droplets from the plurality of nozzles toward the sheet conveyed by the conveyer, under a condition that the second flushing processing has been completed, and under a condition that the elapsed time is less than the threshold time, and that the controller receives the recording command from the information processing apparatus via the communicating interface, the controller is configured to control the recording head to execute the recording processing without executing the second flushing processing.

2. The ink-jet printer according to claim 1, wherein under a condition that the controller receives the recording command from the information processing apparatus via the communicating interface, the controller is configured to determine whether or not the elapsed time, elapsed after the completion of the first flushing processing, is not less than the threshold time.

3. The ink-jet printer according to claim 2, wherein the controller is configured to estimate viscosity of the ink to be supplied to the recording head, before determining whether or not the elapsed time, elapsed after the completion of the first flushing processing, is not less than the threshold time; and in a case that the controller estimates that the viscosity is not less than a threshold viscosity, the controller makes the threshold time to be shorter as compared with another case that the controller estimates that the viscosity is less than the threshold viscosity.

4. The ink-jet printer according to claim 2, wherein the recording command includes image quality information related to quality of an image to be recorded in the recording processing, the quality of the image to be recorded being quantified as a quantified quality; and in a case that a quantified quality related to the image quality information is not less than a threshold image quality, the controller makes the threshold time to be shorter as compared with another case that another quantified quality related to another image quality information is less than the threshold image quality.

5. The ink-jet printer according to claim 1, wherein the controller makes an ink amount of the ink to be jetted as the ink droplets from the plurality of nozzles toward the ink receiver in the second flushing processing, to be greater as the elapsed time becomes longer.

6. The ink-jet printer according to claim 1, wherein the controller determines an ink amount of the ink to be jetted as the ink droplets from the plurality of nozzles toward the ink receiver in the second flushing processing, such that an ink amount determined when the elapsed time is a first time period becomes greater than an ink amount determined when the elapsed time is a second time period that is shorter than the first time period.

7. The ink-jet printer according to claim 1, wherein the preceding command includes generation time information regarding length of a time required for generation of the recording command;

the controller is configured to estimate, prior to the first flushing processing, whether or not the elapsed time becomes not less than the threshold time, based on the generation time information;

under a condition that the controller estimates that the elapsed time becomes less than the threshold time, the controller causes the recording head to jet, in the first flushing processing, the ink droplets in a first ink amount required for executing the recording processing; and under a condition that the controller estimates that the elapsed time becomes not less than the threshold time, the controller causes the recording head to jet, in the first flushing processing, the ink droplets in a second ink amount smaller than the first ink amount, and to execute the second flushing processing regardless of the length of the elapsed time.

8. The ink-jet printer according to claim 1, wherein the controller allows the recording head to jet the ink droplets in the first flushing processing in an ink amount greater than an ink amount of the ink droplets in which the controller allows the recording head to jet the ink droplets in the second flushing processing.

9. The ink-jet printer according to claim 1, wherein the controller executes, in parallel with the second flushing processing, causing the conveyer to feed the sheet toward the recording head.

10. The ink-jet printer according to claim 9, wherein under a condition that the controller judges that the elapsed time reaches another threshold time longer than the threshold time, the controller is configured to execute:

moving the carriage toward the first position, and changing the relative position of the cap relative to the recording head from the separate position to the covering position under a condition that the carriage has reached the first position; and under a condition that the controller receives the recording command after the controller has changed the relative position of the cap relative to the recording head from the separate position to the covering position, the controller is configured to execute: the moving of the carriage from the first position to the second position, the first flushing processing, and the recording processing.

11. The ink-jet printer according to claim 1, further comprising:

a carriage having the recording head mounted thereon and configured to be moved in a scanning direction, crossing the conveyance direction; and a cap configured to face the recording head in a case that the carriage is located at a first position located at outside of the sheet facing area in the scanning direction; and a cap shifter configured to move the cap relative to the recording head between a covering position at which the cap covers the plurality of nozzles and a separate position at which the cap is separated further from the recording head than the covering position in the case that the carriage is located at the first position, wherein the ink receiver faces the recording head, in a case that the carriage is located at a second position which is located on the outside of the sheet facing area in the scanning direction and which is different from the first position; and under the condition that the communicating interface receives the preceding command, the controller is configured to execute:

changing a relative position of the cap relative to the recording head from the covering position to the separate position, moving the carriage from the first position toward the second position, under a condition that the cap is separated relative to the recording head, and the first flushing processing under a condition that the carriage has reached the second position.

* * * * *